US009222367B2

(12) United States Patent
Inoshita et al.

(10) Patent No.: US 9,222,367 B2
(45) Date of Patent: Dec. 29, 2015

(54) TURBOCHARGER AND MANUFACTURING METHOD FOR TURBOCHARGER

(75) Inventors: Hirofumi Inoshita, Nagoya (JP); Koichi Mine, Toyota (JP); Tomoyuki Isogai, Toyota (JP); Tatsuo Iida, Anjo (JP); Akira Sato, Toyota (JP); Takuya Kajita, Nagoya (JP); Hideki Yoshikane, Nagoya (JP)

(73) Assignees: TOYOTA JIDOSHA KABUSHIKI KAISHA, Aichi-ken (JP); AISIN TAKAOKA CO., LTD., Aichi-ken (JP)

( * ) Notice: Subject to any disclaimer, the term of this patent is extended or adjusted under 35 U.S.C. 154(b) by 726 days.

(21) Appl. No.: 13/144,178

(22) PCT Filed: Jan. 14, 2010

(86) PCT No.: PCT/IB2010/000059
§ 371 (c)(1),
(2), (4) Date: Jul. 12, 2011

(87) PCT Pub. No.: WO2010/082119
PCT Pub. Date: Jul. 22, 2010

(65) Prior Publication Data

US 2011/0274542 A1 Nov. 10, 2011

(30) Foreign Application Priority Data

Jan. 15, 2009 (JP) ..... 2009-006985

(51) Int. Cl.
*F01D 25/26* (2006.01)
*F01D 25/24* (2006.01)
(Continued)

(52) U.S. Cl.
CPC ..... *F01D 25/24* (2013.01); *F01D 9/026* (2013.01); *F01D 17/165* (2013.01); *F05D 2220/40* (2013.01); *F05D 2230/25* (2013.01); *F05D 2300/502* (2013.01); *Y10T 29/49245* (2015.01)

(58) Field of Classification Search
CPC ..... F01D 23/24; F01D 23/26; F01D 23/28; F01D 23/243; F01D 23/246; F01D 9/026; F01D 25/24; F02B 39/00; F02B 33/44
USPC ..... 415/206, 213.11, 214.1, 915; 29/889.2, 29/257.1
See application file for complete search history.

(56) References Cited

U.S. PATENT DOCUMENTS 6,553,762 B2 * 4/2003 Loffler et al. ..... 60/605.1
6,951,450 B1 10/2005 Figura et al.
(Continued)

FOREIGN PATENT DOCUMENTS

CN 1561431 A 1/2005
EP 1 422 385 A1 5/2004
(Continued)

OTHER PUBLICATIONS

"Springer Handbook of Mechanical Engineering" vol. 10, p. 587, published Jan. 13, 2009, edited by Karl-Heinrich Grote et al.*
(Continued)

*Primary Examiner* — Craig Kim
*Assistant Examiner* — Kayla McCaffrey
(74) *Attorney, Agent, or Firm* — Sughrue Mion, PLLC

(57) ABSTRACT

A turbocharger includes: a turbine wheel that is driven by exhaust gas from an engine and supported rotatably by a predetermined rotary shaft; and a turbine housing that forms an exhaust gas passage that leads the exhaust gas to the turbine wheel, wherein the turbine housing includes a housing main body constituted by a plate-form member and a reinforcement member that forms the exhaust gas passage together with the housing main body and reinforces the housing main body, the reinforcement member includes a pair of annular portions having a substantially annular shape and provided about an axial center of the rotary shaft at an interval in an axial direction of the rotary shaft, and a connecting portion that connects the pair of annular portions, and the pair of annular portions and the connecting portion are molded integrally by implementing deformation processing on the plate-form member.

6 Claims, 11 Drawing Sheets

(51) Int. Cl.
*F01D 9/02* (2006.01)
*F01D 17/16* (2006.01)

(56) References Cited

U.S. PATENT DOCUMENTS

| | | | | |
|---|---|---|---|---|
| 2004/0205966 | A1 | 10/2004 | Ohishi | |
| 2007/0113550 | A1* | 5/2007 | Sausee et al. | 60/598 |

FOREIGN PATENT DOCUMENTS

| | | | |
|---|---|---|---|
| JP | 59-073503 | U | 5/1984 |
| JP | 62-182433 | A | 8/1987 |
| JP | 11-210417 | A | 8/1999 |
| JP | 2001-131696 | A | 5/2001 |
| JP | 2003-049604 | A | 2/2003 |
| JP | 2005-002849 | A | 1/2005 |
| JP | 2008-106667 | A | 5/2008 |
| JP | 2008-121470 | A | 5/2008 |

OTHER PUBLICATIONS

"Fundamentals of Design and Manufacturing" by G.K. Lal et al., p. 136, published Jan. 3, 2006 by Alpha Science Intl Ltd.*

"Basic Fluid Mechanics" published 1999 by New Age International, Ltd., and authored by C.P. Kothandaraman et al., see pertinent p. 275.*

International Search Report and Written Opinion for corresponding International Patent Application No. PCT/IB2010/000059 mailed Feb. 2, 2011.

Japanese Office Action for corresponding JP Patent Application No. 2009-006985 drafted Oct. 12, 2010.

* cited by examiner

TURBOCHARGER AND MANUFACTURING METHOD FOR TURBOCHARGER

BACKGROUND OF THE INVENTION

1. Field of the Invention

The invention relates to a turbocharger installed in an engine, such as an automobile engine, and a method of manufacturing the turbocharger.

2. Description of the Related Art

A conventional engine such as an automobile engine, for example, may be installed with a turbocharger to achieve improvements in engine output and so on. The turbocharger turns exhaust gas from the engine into a power supply using a turbine wheel, and supercharges the engine.

There is a great need to reduce a heat capacity of the turbocharger in order to improve the cleanliness of the exhaust gas. The reason for this is as follows. A catalyst device that purifies the exhaust gas using a catalyst such as a nitrogen oxide (NOx) reduction catalyst may be provided in the engine on a downstream side of the turbocharger with respect to the exhaust gas flow. When the temperature of the catalyst in the catalyst device is within a predetermined range, the catalyst is activated such that the exhaust gas is purified efficiently.

Hence, when the heat capacity of the turbocharger is large, it is difficult to increase the temperature of the catalyst that purifies the exhaust gas from a state in which the temperature of the catalyst must be raised to an activation temperature (a temperature at which the catalyst is activated), for example during engine startup or the like. In other words, the temperature of the catalyst in the catalyst device is raised by heat from the exhaust gas passing through the turbocharger, and therefore, when the heat capacity of the turbocharger is large, a large amount of heat is lost from the exhaust gas, thereby making it difficult to raise the temperature of the catalyst.

As regards the heat capacity of the turbocharger, the heat capacity of a housing (turbine housing) that forms an exhaust gas passage for leading the exhaust gas from the engine into the turbine wheel has a particularly large effect on increases in the temperature of the exhaust gas. Therefore, as the heat capacity of the turbine housing, which serves as an exhaust system component of the engine, decreases, the amount of heat lost from the exhaust gas decreases, making it possible to raise the temperature of the catalyst to the activation temperature quickly such that the cleanliness of the exhaust gas is improved.

Various proposals have been made in the related art for reducing the heat capacity of a turbocharger. One of these proposals is a technique for reducing the thickness of the turbine housing or forming the turbine housing from sheet metal (to be referred to simply as "reducing the thickness of the turbine housing" hereafter). The thickness of the turbine housing can be reduced by forming the turbine housing from a thin plate material obtained by press-molding a heat-resistant material such as stainless steel (SUS) sheet metal, for example. However, reducing the thickness of the turbine housing may lead to a reduction in the rigidity of the turbine housing. A reduction in the rigidity of the turbine housing leads to a reduction in the performance (turbo efficiency) and reliability of the turbocharger and a reduction in the durability of the turbine housing.

More specifically, a turbine housing having reduced rigidity caused by a reduction in thickness is more likely to undergo thermal deformation due to thermal expansion and thermal contraction occurring during a thermal cycle that accompanies an operation of the engine, thermal deformation in constitutional components of the engine or peripheral components (a support stay and so on) of the turbocharger, vibration input during an operation of the engine, and so on. When thermal deformation occurs in the turbine housing, a gas leak may occur due to deformation of a gas seal portion of the turbine housing, an increase in clearance between the turbine housing and another member, and so on. When this type of gas leak occurs in the turbocharger, the performance and reliability of the turbocharger deteriorate. Furthermore, when thermal deformation occurs during an operation of the engine or the like in a turbine housing having reduced rigidity caused by a reduction in thickness, or the turbine housing deforms due to thermal deformation of a peripheral component, it becomes difficult to secure sufficient durability in the turbine housing.

To solve these problems accompanying a reduction in the thickness of the turbine housing, a turbocharger may be provided with a member (to be referred to hereafter as a "reinforcement member") that reinforces the turbine housing (see Japanese Patent Application Publication No. 2008-106667 (JP-A-2008-106667) and Japanese Patent Application Publication No. 2008-121470 (JP-A-2008-121470), for example). In other words, the rigidity of a housing main body, i.e. the part of the turbine housing formed from a thin plate material, is secured by the reinforcement member. The reinforcement member takes an overall substantially annular shape, and is provided about a rotary axis center of the turbocharger so as to surround a housing main body forming an exhaust gas passage.

More specifically, the reinforcement member includes a pair of ring-shaped annular portions provided about the rotary axis center of the turbocharger at an interval in a rotary axis direction, and a columnar connecting portion that connects the annular portions. The turbine housing is formed by fixing the annular portions on either side to the housing main body by welding or the like such that the reinforcement member is fixed to the housing main body.

In a conventional reinforcement member provided on a housing main body constituted by a thin plate material, constitutional components of the pair of annular portions and the connecting portion that connects the pair of annular portions are formed integrally by welding or casting. More specifically, in a turbocharger disclosed in JP-A-2008-106667, a pair of flanges constituting the pair of annular portions of the reinforcement member are integrated by being welded to a connecting ring constituting the connecting portion of the reinforcement member. JP-A-2008-106667 also states that the pair of flanges constituting the annular portions may be manufactured as an integral cast component including the connecting portion. In a turbocharger disclosed in JP-A-2008-121470, a pair of base portions constituting the pair of annular portions and a connecting portion that connects the pair of base portions are likewise formed integrally by casting.

However, when the reinforcement member of the turbine housing is a cast component or an integral welded structure, the following problems arise. When the reinforcement member is constituted by a cast component, the surface roughness of a surface thereof is likely to increase, leading to an increase in loss of a fluid (exhaust gas) flowing over a wall surface of the reinforcement member. Furthermore, a cast component must be machined to compensate for a lack of precision in the formed material, leading to an increase in cost. Meanwhile, when the reinforcement member is constituted by an integral welded structure, welding processes must be performed, thereby increasing the complexity of the processing. Moreover, in the case of a welded structure, welding distortion leads to a reduction in precision, causing an increase in cost.

Further, it has been learned through experiments and the like that an external force acting on the reinforcement member due to thermal deformation of the housing main body and peripheral components during an engine operation and so on is mainly constituted by a load that acts in a direction for compressing the reinforcement member in the rotary axis direction of the turbocharger or a load (a stretching force) that acts in a direction for pulling the reinforcement member in the rotary axis direction. This external force input into the reinforcement member increases the amount by which the reinforcement member deforms, leading to a reduction in the fatigue life of the reinforcement member.

SUMMARY OF THE INVENTION

An aspect of the invention provides a turbocharger and a method of manufacturing the turbocharger with which an amount by which a turbine housing deforms due to thermal deformation can be reduced, leading to an improvement in the fatigue life and a reduction in the cost of the turbine housing, and with which favorable surface roughness can be obtained such that loss of exhaust gas flowing along a wall surface is suppressed.

A turbocharger according to a first aspect of the invention includes: a turbine wheel that is driven by exhaust gas from an engine and supported rotatably by a predetermined rotary shaft; and a turbine housing that forms an exhaust gas passage that leads the exhaust gas to the turbine wheel, wherein the turbine housing includes a housing main body constituted by a plate-form member and a reinforcement member that forms the exhaust gas passage together with the housing main body and reinforces the housing main body, the reinforcement member includes a pair of annular portions having a substantially annular shape and provided about an axial center of the rotary shaft at an interval in an axial direction of the rotary shaft, and a connecting portion that connects the pair of annular portions, and the pair of annular portions and the connecting portion are molded into an integral component by implementing deformation processing on the plate-form member.

In the aspect described above, the deformation processing may be cold forging in which residual compressive stress or residual tensile stress is applied to at least the connecting portion part of the reinforcement member in the axial direction of the rotary shaft in order to counteract an external force acting on the reinforcement member in the axial direction of the rotary shaft.

In the aspect described above, an exhaust gas passage hole that leads the exhaust gas to a diametrical direction inner side of the rotary shaft may be formed in the connecting portion, and the exhaust gas passage hole may be formed by punching the connecting portion from the diametrical direction inner side to a diametrical direction outer side of the rotary shaft.

In the aspect described above, the exhaust gas passage hole may be an elongated hole having a circumferential direction of the annular portion as a lengthwise direction, and may be provided in a plurality in the circumferential direction of the annular portion in opposing positions relative to the diametrical direction of the rotary shaft.

In the aspect described above, the pair of annular portions may include a first annular portion positioned on an outlet side of the exhaust gas led to the turbine wheel with respect to the axial direction of the rotary shaft, and a second annular portion positioned further toward the diametrical direction outer side of the rotary shaft than the first annular portion and on an opposite side to the outlet side with respect to the axial direction of the rotary shaft, the connecting portion may include a cylindrical portion constituted by a cylindrical part having an axial center direction of the rotary shaft as a cylinder axis direction, one side of which in the cylinder axis direction is continuous with an inner peripheral side of the second annular portion, and an R-shaped portion constituted by a bent part extending continuously from another side of the cylindrical portion in the cylinder axis direction toward an outer peripheral side of the first annular portion, and the exhaust gas passage holes may be provided in the cylindrical portion.

In the aspect described above, a hole may be formed in the first annular portion, and the hole may be provided in a position corresponding substantially to a center of the exhaust gas passage hole with respect to the circumferential direction of the annular portion.

In the aspect described above, the turbine housing may be supported by a support member that is provided on an end portion of the outlet side of the exhaust gas led to the turbine wheel and includes a fastening support portion that extends to the diametrical direction outer side of the rotary shaft and is fastened to a main body side of the engine, and the support member may be provided relative to column portions serving as parts disposed between adjacent exhaust gas passage holes in the circumferential direction of the annular portion such that with respect to a phase centering on the axial center of the rotary shaft, a phase of the fastening support portion is an intermediate phase between adjacent column portions in the circumferential direction of the annular portion.

In the aspect described above, an $\Delta r$ value indicating plastic anisotropy of the plate-form member constituting the reinforcement member may have an absolute value that does not exceed 0.25.

In a manufacturing method for a turbocharger according to a second aspect of the invention, wherein the turbocharger includes a turbine wheel that is driven by exhaust gas from an engine and supported rotatably by a predetermined rotary shaft and a turbine housing that forms an exhaust gas passage that leads the exhaust gas to the turbine wheel, and wherein the turbine housing includes a housing main body constituted by a plate-form member and a reinforcement member that forms the exhaust gas passage together with the housing main body and reinforces the housing main body, the manufacturing method includes: molding the reinforcement member integrally by implementing deformation processing on a plate-form member to obtain a component that includes a pair of annular portions having a substantially annular shape and provided about an axial center of the rotary shaft at an interval in an axial direction of the rotary shaft, and a connecting portion that connects the pair of annular portions.

In the aspect described above, cold forging, in which residual compressive stress or residual tensile stress is applied to at least the connecting portion part of the reinforcement member in the axial direction of the rotary shaft in order to counteract an external force acting on the reinforcement member in the axial direction of the rotary shaft, may be performed as the deformation processing.

In the aspect described above, an exhaust gas passage hole that leads the exhaust gas to a diametrical direction inner side of the rotary shaft may be formed in the connecting portion by punching the connecting portion from the diametrical direction inner side to a diametrical direction outer side of the rotary shaft.

In the aspect described above, the exhaust gas passage hole may be an elongated hole having a circumferential direction of the annular portion as a lengthwise direction, and the exhaust gas passage hole may be formed in the circumferential direction of the annular portion in opposing positions relative to the diametrical direction of the rotary shaft by a single process.

In the aspect described above, a first annular portion positioned on an outlet side of the exhaust gas led to the turbine wheel with respect to the axial direction of the rotary shaft and a second annular portion positioned further toward the diametrical direction outer side of the rotary shaft than the first annular portion and on an opposite side to the outlet side with respect to the axial direction of the rotary shaft may be formed as the pair of annular portions, the connecting portion may be formed as a part that includes a cylindrical portion constituted by a cylindrical part having an axial center direction of the rotary shaft as a cylinder axis direction, one side of which in the cylinder axis direction is continuous with an inner peripheral side of the second annular portion, and an R-shaped portion constituted by a bent part extending continuously from another side of the cylindrical portion in the cylinder axis direction toward an outer peripheral side of the first annular portion, and the exhaust gas passage holes may be provided in the cylindrical portion.

In the aspect described above, a hole may be provided in a position of the first annular portion, the position corresponding substantially to a center of the exhaust gas passage hole with respect to the circumferential direction of the annular portion.

In the aspect described above, the turbine housing may be supported by a support member that is provided on an end portion of the outlet side of the exhaust gas led to the turbine wheel and includes a fastening support portion that extends to the diametrical direction outer side of the rotary shaft and is fastened to a main body side of the engine, and the support member may be provided relative to column portions serving as parts disposed between adjacent exhaust gas passage holes in the circumferential direction of the annular portion such that with respect to a phase centering on the axial center of the rotary shaft, a phase of the fastening support portion is an intermediate phase between adjacent column portions in the circumferential direction of the annular portion.

In the aspect described above, a material in which an absolute value of an $\Delta r$ value indicating plastic anisotropy does not exceed 0.25 may be used as the plate-form member constituting the reinforcement member.

The following effects are obtained by these aspects of the invention. According to these aspects of the invention, an amount by which a turbine housing deforms due to thermal deformation can be reduced, leading to an improvement in the fatigue life and a reduction in the cost of the turbine housing, and favorable surface roughness can be obtained such that loss of exhaust gas flowing along a wall surface is suppressed.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein.

DETAILED DESCRIPTION OF EMBODIMENTS

In an embodiment of the invention, a turbine housing forming a turbocharger includes a housing main body that is reduced in thickness by subjecting heat-resistant steel plate to press-molding or the like, and a reinforcement member for reinforcing the housing main body. The reinforcement member is molded integrally by deformation processing such as press-molding. An embodiment of the invention will be described below.

Figure 1:
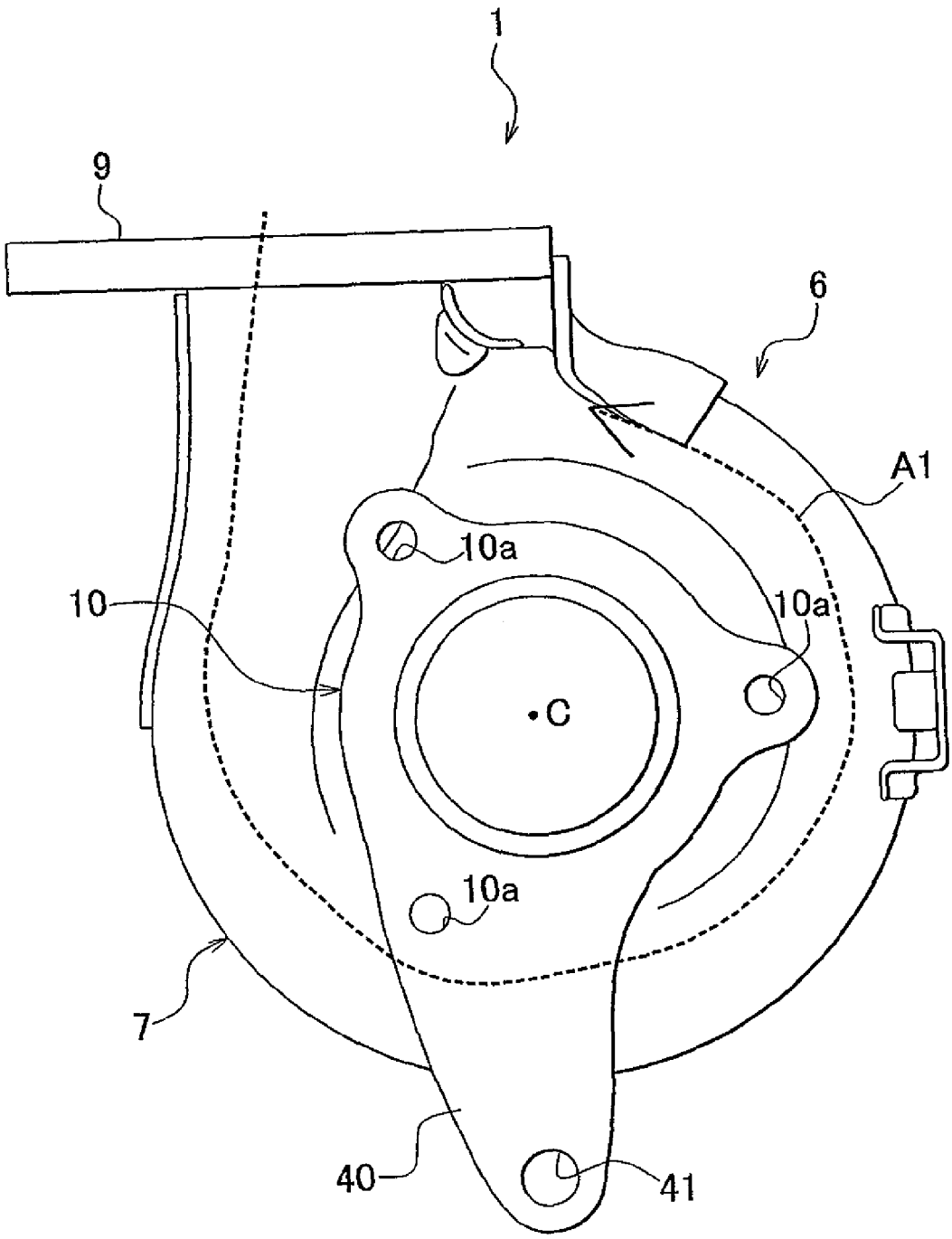
FIG. 1 is a view showing a turbocharger according to an embodiment of the invention.
Figure 2:
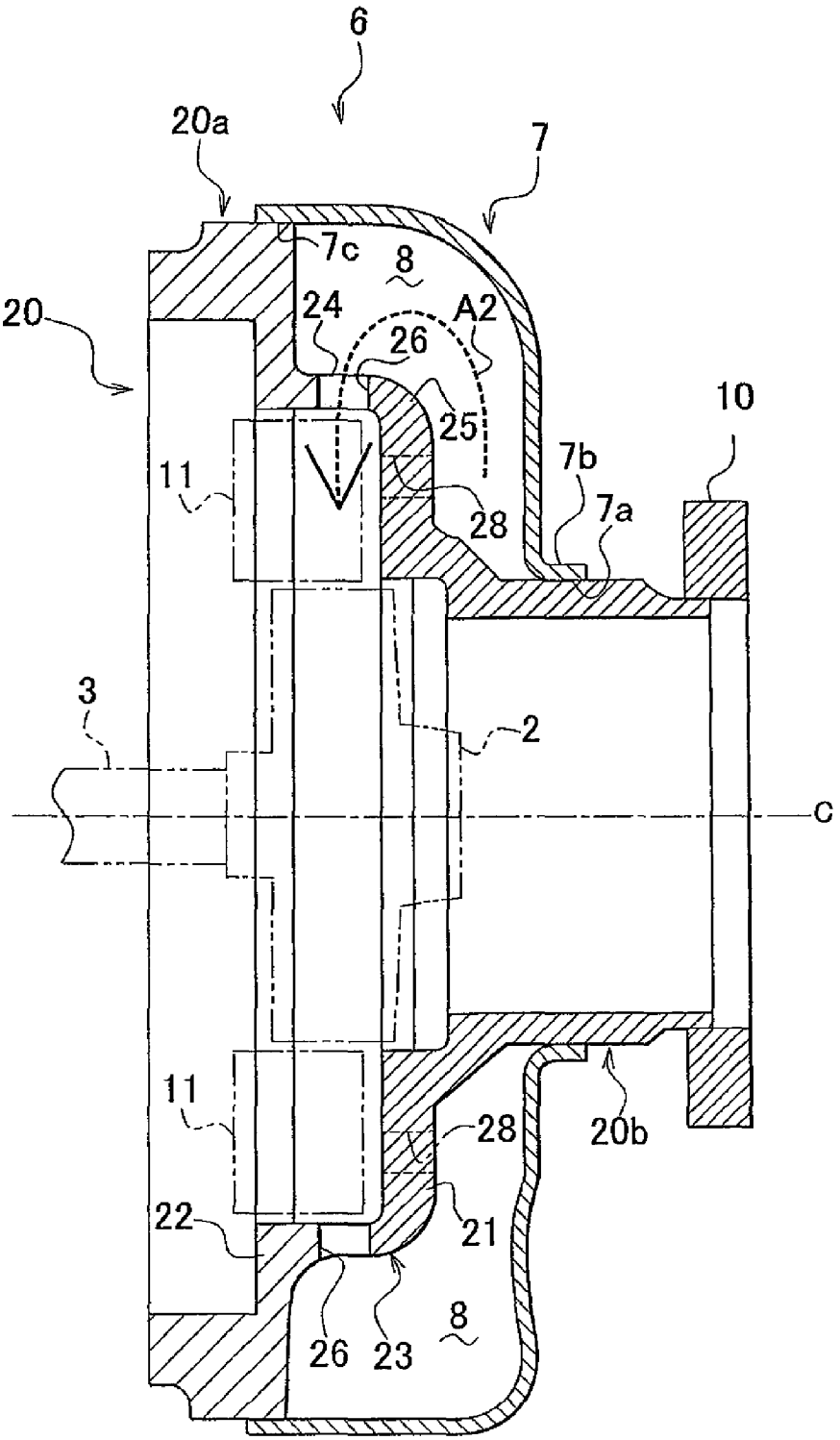
FIG. 2 is a sectional view showing the constitution of a turbine housing according to an embodiment of the invention.
Figure 3:
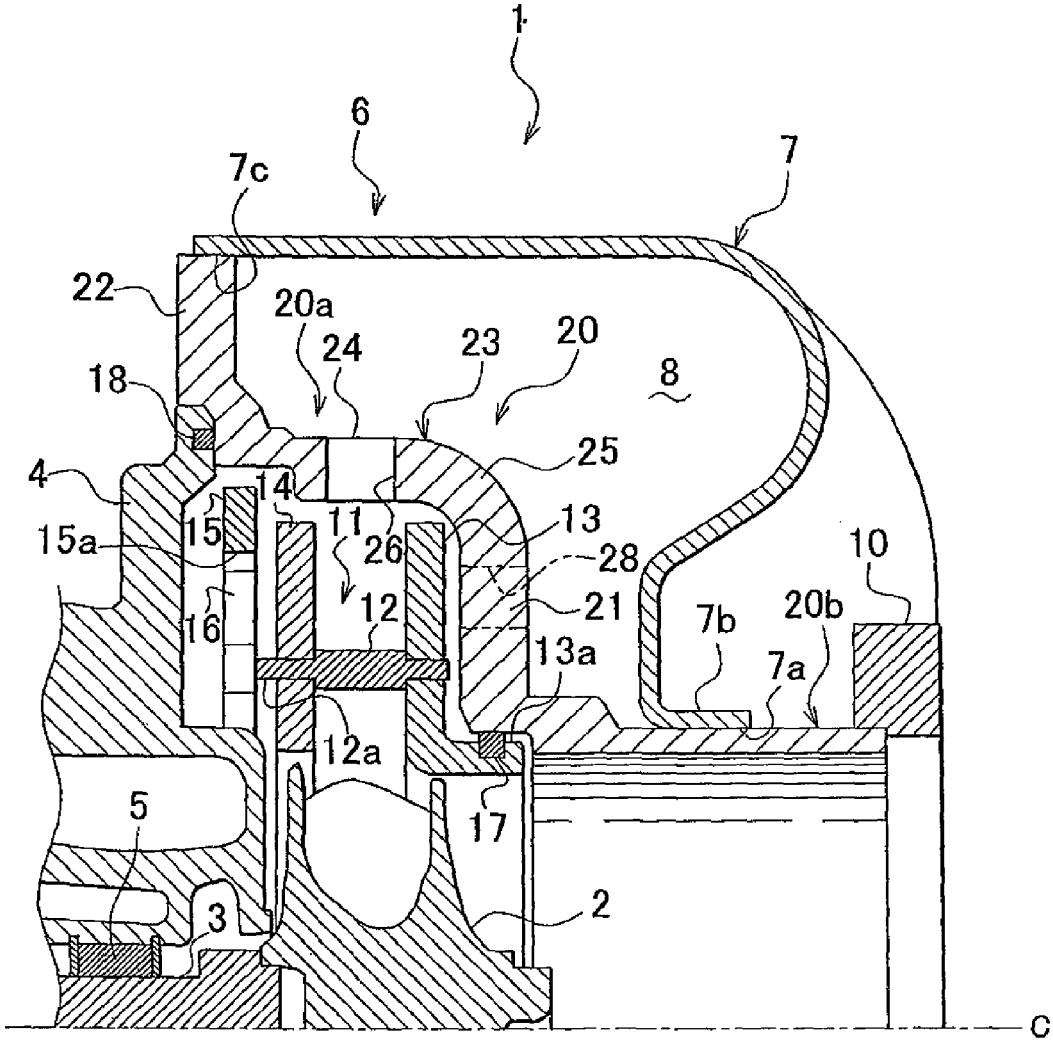
FIG. 3 is a partial sectional view showing the constitution of the turbocharger according to an embodiment of the invention.

As shown in FIGS. 1 to 3, a turbocharger 1 according to this embodiment is installed in an engine such as an automobile engine, for example, and includes a turbine wheel 2 that turns exhaust gas from the engine into a power supply. The turbine wheel 2 rotates upon reception of the exhaust gas from the engine, and is supported rotatably by a rotary shaft 3.

The rotary shaft 3 is supported rotatably in the interior of a bearing housing 4 (FIG. 3) forming the turbocharger 1. The rotary shaft 3 is supported to be capable of rotating relative to the bearing housing 4 about a predetermined rotary axis center C via a bearing 5 (FIG. 3) or the like. The turbine wheel 2 is fixed to one end side of the rotary shaft 3. With this constitution, the turbine wheel 2 is provided to be capable of rotating in the turbocharger 1 about the rotary axis center C.

The turbocharger 1 includes a compressor wheel (not shown), and by rotating the compressor wheel, the turbocharger 1 collects and compresses the exhaust gas from the engine and supercharges the engine with the compressed exhaust gas. The compressor wheel is fixed to another end side of the rotary shaft 3, or in other words the opposite side of the rotary shaft 3 to the side on which the turbine wheel 2 is provided. Thus, the compressor wheel rotates in accordance with the rotation of the turbine wheel 2, which rotates upon reception of the exhaust gas from the engine as described above.

Hence, in the turbocharger 1, a rotary body that rotates integrally while supported on the bearing housing 4 is formed from a constitution including the rotary shaft 3 and the turbine wheel 2 and compressor wheel fixed to the respective end sides of the rotary shaft 3.

The turbine wheel 2 is positioned on the outside of the bearing housing 4 supporting the rotary shaft 3 and covered by a turbine housing 6. As shown in FIG. 3, the turbine housing 6 is attached to one side (the side on which the turbine wheel 2 is provided) of the bearing housing 4. The turbine housing 6 includes a shell 7 serving as a housing main body and an annular base 20 serving as a reinforcement member that reinforces the shell 7.

The shell 7 is a member used to form an exhaust gas passage about the rotary axis center C of the turbocharger 1. The shell 7 is constituted by a thin plate material formed by press-molding a heat-resistant material such as SUS sheet metal, for example. Note that the shell 7 may be constituted by a thin plate material formed by so-called hydroforming, in which a hollow member is molded using fluid pressure.

The shell 7 is a housing member having a substantially annular outer form when seen from an axial center direction of the rotary shaft 3 (see FIG. 1). A circular hole portion 7*a* centering on the rotary axis center C is formed on one side (the right side in FIG. 2) of the shell 7 in an axial direction (the direction of the rotary axis center C, to be referred to hereafter as a "turbo axis direction") of the rotary shaft 3. The hole portion 7*a* is formed from a cylindrical portion 7*b* that projects to the outside of the shell 7 (the right side in FIG. 2) in a cylindrical shape. In other words, the hole portion 7*a* is formed by an inner peripheral surface of the cylindrical portion 7*b*. The cylindrical portion 7*b* is formed such that a cylinder axis direction thereof is in alignment with the turbo axis direction.

Further, the other side (the left side in FIG. 2) of the shell 7 in the turbo axis direction is fully open. In other words, the other side of the shell 7 in the turbo axis direction serves as an opening portion 7*c* formed by a cylindrical inner peripheral surface.

The annular base 20 has a substantially annular outer form that corresponds to the shape of the shell 7. The annular base 20 forms the exhaust gas passage about the rotary axis center C together with the shell 7. The annular base 20 includes a base main body portion 20*a* having a substantially annular shape, and a sleeve portion 20*b* having a substantially cylindrical shape.

The base main body portion 20*a* and the sleeve portion 20*b* are both provided such that axial center positions thereof match the rotary axis center C of the turbocharger 1. More specifically, the base main body portion 20*a* is provided such that a central axis direction thereof is in alignment with the turbo axis direction, and the sleeve portion 20*b* is provided such that a cylinder axis direction thereof is in alignment with the turbo axis direction. The sleeve portion 20*b* is formed to project from one side of the base main body portion 20*a* in the turbo axis direction.

The annular base 20 is provided on the inside of the shell 7. In other words, the shell 7 is provided to cover the annular base 20 from the outside. More specifically, the annular base 20 is fixed to the shell 7 such that the sleeve portion 20*b* projects from the inside of the shell 7 through the hole portion 7*a* (i.e. such that the sleeve portion 20*b* penetrates the hole portion 7*a*).

In this embodiment, the shell 7 and the annular base 20 are joined to each other fixedly by welding. Welding locations between the shell 7 and the annular base 20 include a contact portion between the inner peripheral surface of the cylindrical portion 7*b* forming the hole portion 7*a* of the shell 7 and an outer peripheral surface of the sleeve portion 20*b* of the annular base 20, and a contact portion between the inner peripheral surface forming the opening portion 7*c* of the shell 7 and an outer peripheral surface of the base main body portion 20*a*. In each of these welding locations, welding is implemented around substantially an entire periphery centering on the rotary axis center C, for example.

Hence, when fixed to each other to constitute the turbine housing 6, the shell 7 and the annular base 20 form an annular, tunnel-shaped space about the rotary axis center C. This space serves as an exhaust gas passage 8 for leading the exhaust gas from the engine to the turbine wheel 2. The exhaust gas passage 8 is shaped such that the exhaust gas from the engine flows while revolving in a direction that follows the rotation direction of the turbine wheel 2 (i.e. about the rotary axis center C).

An inlet flange 9 is provided in the turbine housing 6 at an exhaust gas inlet to the exhaust gas passage 8 (FIG. 1). The inlet to the exhaust gas passage 8 is formed as an opening portion that opens onto one side (the upper side in FIG. 1) of the shell 7. The inlet flange 9 is provided on a peripheral edge of the inlet to the exhaust gas passage 8. An exhaust pipe forming a passage for the exhaust gas that is discharged from the engine is connected to the inlet flange 9.

Further, an outlet flange 10 is provided in the turbine housing 6 at an exhaust gas outlet. The exhaust gas outlet is formed in the annular base 20 by the sleeve portion 20*b* that opens onto one side (the right side in FIG. 2) of the annular base 20 in the turbo axis direction. The outlet flange 10 is provided on the exhaust gas outlet, or in other words a peripheral edge of a tip end opening portion of the sleeve portion 20*b*. The outlet flange 10 is fixed to the sleeve portion 20*b* by performing welding or the like on the outer peripheral surface of the sleeve portion 20*b*, for example. An exhaust pipe forming a passage for exhaust gas that has passed through the turbocharger 1 is connected to the outlet flange 10. Accordingly, the outlet flange 10 is provided with a bolt hole 10*a* for connecting the outlet flange 10 to the exhaust pipe (FIG. 1).

In this constitution, exhaust gas that has been discharged from the engine so as to flow into the exhaust gas passage 8 from the inlet flange 9 side revolves around the rotary axis center C (see arrow A1 in FIG. 1) and then flows to the rotary axis center C side so as to be led to the turbine wheel 2. After rotating the turbine wheel 2, the exhaust gas passes through the sleeve portion 20*b* of the annular base 20 in accordance with the rotation of the turbine wheel 2, and is then discharged into the exhaust pipe via the outlet flange 10.

The exhaust gas that revolves around the exhaust gas passage 8 is led to the turbine wheel 2 positioned on the inside of the annular base 20 via the annular base 20 (see arrow A2 in FIG. 2). For this purpose, an exhaust gas passage hole 26 serving as a hole portion for leading the exhaust gas flowing through the exhaust gas passage 8 to the turbine wheel 2 is formed in the base main body portion 20*a* of the annular base 20.

Note that a catalyst device that purifies the exhaust gas using a catalyst such as a NOx reduction catalyst is provided in an exhaust passage for the exhaust gas that is discharged from the turbocharger 1. In other words, the exhaust gas that is discharged into the exhaust pipe via the outlet flange 10, as described above, is purified by the catalyst device before being discharged into the atmosphere.

Further, the turbocharger 1 is provided with a VN mechanism portion 11. The VN mechanism portion 11 is provided on an upstream side of the turbine wheel 2 with respective to the exhaust gas flow through the turbocharger 1. More specifically, the VN mechanism portion 11 is positioned between the exhaust gas passage 8 and the turbine wheel 2.

The VN mechanism portion 11 forms an exhaust gas flow passage (to be referred to hereafter as a "turbine gas flow passage") extending from the exhaust gas passage 8 to the turbine wheel 2 and adjusts an opening of the turbine gas flow passage. The VN mechanism portion 11 includes a plurality of nozzle vanes 12. The opening of the turbine gas flow passage is adjusted by adjusting a tilt of the nozzle vanes 12. More specifically, the VN mechanism portion 11 adjusts the opening of the turbine gas flow passage in accordance with engine operating conditions and so on, whereby a flow speed, a flow rate, and so on of the exhaust gas acting on the turbine wheel 2 are adjusted.

Figure 4:
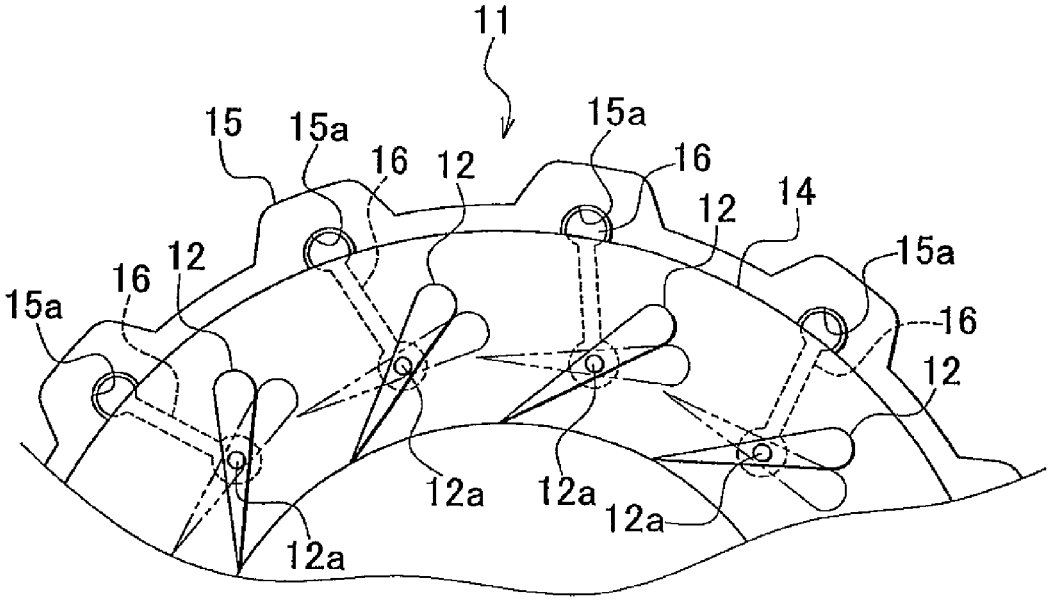
FIG. 4 is a view showing the constitution of a variable nozzle (VN) mechanism portion.

As shown in FIGS. 3 and 4, the nozzle vanes 12 are substantially rectangular plate-form members which are supported rotatably (tiltably) such that a plate surface direction thereof is in alignment with the turbo axis direction. The nozzle vanes 12 are provided around the entire circumference of the rotary shaft 3 at equal intervals in a circumferential direction (see FIG. 4). Opposing plate surfaces of adjacent nozzle vanes 12 form the turbine gas flow passage. With this constitution, the opening of the turbine gas flow passage is adjusted by adjusting the tilt (rotation angle) of the nozzle vanes 12.

As shown in FIG. 3, the nozzle vanes 12 are supported rotatably by being sandwiched between support plates 13, 14 provided at an interval in the turbo axis direction. The support plates 13, 14 are provided such that a plate surface thereof is perpendicular to the turbo axis direction. Both support plates 13, 14 have a substantially annular shape, and are provided in the interior of the turbine housing 6 (the interior of the base main body portion 20*a* of the annular base 20) and positioned on the periphery of the turbine wheel 2.

As shown in FIG. 4, the nozzle vanes 12 are supported to be capable of rotating relative to the support plates 13, 14 by a rotary shaft portion 12*a* provided in a substantially central position in the plate surface direction (a lengthwise direction) when the nozzle vane 12 is seen from the turbo axis direction. The nozzle vanes 12 are rotated using a unison ring 15.

The unison ring 15 is a substantially annular plate-form member provided such that a plate surface thereof is perpendicular to the turbo axis direction, similarly to the support plates 13, 14. The unison ring 15 is provided on a compressor side of the support plate 14, which is positioned on the opposite side (the left side in FIG. 3, to be referred to hereafter as a "compressor side") of the turbo axis direction to the exhaust gas outlet side (the right side in FIG. 3, to be referred to hereafter as an "exhaust outlet side").

The unison ring 15 is provided rotatably such that a central axis direction thereof is in alignment with the turbo axis direction. The unison ring 15 is rotated using driving force from an actuator, not shown in the drawings. The unison ring 15 is connected to the respective nozzle vanes 12 via a driving arm 16. One end side of the driving arm 16 is fitted to a recess portion 15*a* formed in an inner peripheral portion of the unison ring 15, and the other end side is supported coaxially with the rotary shaft portion 12*a* of the nozzle vane 12.

With this constitution, when the unison ring 15 rotates about the rotary axis center C, the driving arm 16 rotates about an axial center of the rotary shaft portion 12*a* of the nozzle vane 12. When the driving arm 16 rotates, the nozzle vanes 12 are rotated by the rotary shaft portion 12*a*. By adjusting the rotation of the unison ring 15 in this manner, the tilt of the nozzle vanes 12 is adjusted, and as a result, the opening of the turbine gas flow passage is adjusted.

Note that in the turbocharger 1, a gas seal portion is provided between the support plate 13 positioned on the exhaust outlet side in the turbo axis direction and the annular base 20. More specifically, as shown in FIG. 3, the support plate 13 includes a cylindrical portion 13*a* that projects in a cylindrical shape toward the exhaust outlet side of the turbo axis direction from an inner peripheral side part of the support plate 13, and the gas seal portion is formed by interposing an annular gasket 17 between an outer peripheral surface of the cylindrical portion 13*a* of the support plate 13 and the inner peripheral surface of the annular base 20.

Further, a gas seal portion is provided in the turbocharger 1 between the bearing housing 4 and the turbine housing 6. More specifically, as shown in FIG. 3, the gas seal portion is formed by interposing an annular gasket 18 in a contact surface between the bearing housing 4 and the annular base 20 of the turbine housing 6. These gas seal portions ensure that the exhaust gas that is led into the exhaust gas passage 8 so as to act on the turbine wheel 2 cannot escape.

The turbocharger 1 constituted as described above functions in the following manner when installed in an engine. Exhaust gas from the engine flows into the exhaust gas passage 8 formed by the turbine housing 6 through an exhaust passage of the engine, and acts on the turbine wheel 2 via the exhaust gas passage hole 26 formed in the annular base 20. As a result, the turbine wheel 2 rotates. Here, the flow speed, flow rate, and so on of the exhaust gas acting on the turbine wheel 2 are adjusted by the VN mechanism portion 11. In accordance with the rotation of the turbine wheel 2, the compressor wheel of the turbocharger 1 is rotated via the rotary shaft 3. When the compressor wheel rotates, the exhaust gas from the engine that has been collected in the turbocharger 1 is compressed and then resupplied to the engine as intake air.

As described above, the turbocharger 1 according to this embodiment includes the turbine housing 6 that forms the exhaust gas passage 8 for leading the exhaust gas from the engine to the turbine wheel 2, which is supported rotatably by the predetermined rotary shaft 3 in order to turn the exhaust gas from the engine into a power supply. Further, the turbine housing 6 includes the shell 7 serving as a housing main body constituted by a plate-form member, and the annular base 20 serving as a reinforcement member that forms the exhaust gas passage 8 together with the shell 7 and reinforces the shell 7.

The annular base 20 that forms the turbine housing 6 will now be described in detail using FIGS. 5 to 7. Note that FIG. 7 is a 7A-7A sectional view of FIG. 6. The annular base 20 includes a pair of substantially ring-shaped annular portions (21, 22) provided about the axial center (the rotary axis center C) of the rotary shaft 3 at an interval in the turbo axis direction, and a connecting portion 23 that connects the pair of annular portions to each other. The pair of annular portions (21, 22) and the connecting portion 23 are the parts of the annular base 20 that constitute the base main body portion 20*a*.

The annular base 20 is formed by molding the pair of annular portions (21, 22) and the connecting portion 23 integrally by subjecting a plate-form member to deformation processing. In other words, the respectively shaped parts of the annular base 20, including the pair of annular portions (21, 22) and the connecting portion 23, are formed by implementing deformation processing on a flat plate-shaped material (a blank).

There are no particular limitations on the deformation processing for forming the annular base 20 as long as it is processing for deforming a blank into a target shape by applying pressure to the blank. For example, cold forging, hot forging, press-molding, and so on may be employed. The plate-form member molded into the annular base 20 is a plate material having a greater plate thickness than the thin plate material constituting the shell 7, for example, and a heat-resistant material such as SUS sheet metal, for example, may be used, similarly to the shell 7.

Hence, in a manufacturing method for the turbocharger according to this embodiment (to be referred to simply as "the manufacturing method" hereafter), the annular base 20 that forms the turbine housing 6 is molded integrally into a component including the pair of annular portions (21, 22) and the connecting portion 23 by subjecting a plate-form member to deformation processing.

A first annular portion 21 is positioned on the outlet side (exhaust outlet side) of the exhaust gas that is led to the turbine wheel 2 with respect to the turbo axis direction. A second annular portion 22 is positioned further toward the outside of a diametrical direction of the rotary shaft 3 (to be referred to hereafter as a "turbo diameter direction") than the first annular portion 21 and on the compressor side with respect to the turbo axis direction.

The first annular portion 21 and second annular portion 22 are both ring-shaped plate-form parts formed such that a plate surface thereof is perpendicular to the turbo axis direction. Furthermore, the first annular portion 21 and second annular portion 22 are both formed such that a central axis direction thereof is in alignment with the turbo axis direction.

The first annular portion 21 forms the part of the base main body portion 20*a* of the annular base 20 from which the sleeve portion 20*b* projects. In other words, the substantially cylindrical sleeve portion 20*b* projects toward the exhaust outlet side from an inner peripheral side part of the ring-shaped first annular portion 21.

The second annular portion 22 forms a maximum outer diameter part of the annular base 20. An outer peripheral surface of the second annular portion 22 corresponds to the outer peripheral surface of the base main body portion 20*a* welded to the inner peripheral surface forming the opening portion 7*c* of the shell 7, as described above. An outer peripheral side end portion of the first annular portion 21 and an inner peripheral side end portion of the second annular portion 22 have substantially identical positions in the turbo diameter direction.

The connecting portion 23 connects the outer peripheral side end portion of the first annular portion 21 and the inner peripheral side end portion of the second annular portion 22, which have substantially identical positions in the turbo diameter direction as described above. The connecting portion 23 includes a cylindrical portion 24 and an R-shaped portion 25.

The cylindrical portion 24 is a cylindrical part having a cylinder axis direction that is in alignment with the axial center direction of the rotary shaft 3, in which one side (the second annular portion 22 side; the left side in FIG. 6) of the cylinder axis direction is continuous with the inner peripheral side of the second annular portion 22. More specifically, the cylindrical portion 24 is formed with an overall cylindrical outer shape by being bent in a substantially perpendicular direction to a plate surface direction of the second annular portion 22 from a part thereof on the inner peripheral side of the second annular portion 22.

The R-shaped portion 25 is a bent part extending continuously from the other side (the first annular portion 21 side; the right side in FIG. 6) of the cylindrical portion 24 in the cylinder axis direction toward the outer peripheral side of the first annular portion 21. More specifically, with respect to the connecting portion 23, which is bent in a substantially perpendicular direction to the first annular portion 21 and second annular portion 22, the R-shaped portion 25 is formed between the first annular portion 21 and the cylindrical portion 24, and has an R-shaped cross-section when seen from the turbo axis direction.

The connecting portion 23 including the cylindrical portion 24 and the R-shaped portion 25 is formed with the exhaust gas passage hole 26 for leading the exhaust gas flowing through the exhaust gas passage 8 to the turbine wheel 2. In other words, in the annular base 20 according to this embodiment, the exhaust gas passage hole 26 for leading the exhaust gas inwardly in the turbo diameter direction is formed by the connecting portion 23.

There are no particular limitations on the shape (hole shape) of the exhaust gas passage hole 26, but in this embodiment, the exhaust gas passage hole 26 is formed as an elongated hole having a circumferential direction of the first annular portion 21 and second annular portion 22 (the circumferential direction of the rotary shaft 3, to be referred to hereafter as a "turbo circumference direction") as a lengthwise direction. Furthermore, in this embodiment, four exhaust gas passage holes 26 are provided at equal intervals in the turbo circumference direction.

Column portions 27 are formed in the annular base 20 between adjacent exhaust gas passage holes 26 in the turbo circumference direction. The column portion 27 partially connects respective parts of the annular base 20 on the first annular portion 21 side of the exhaust gas passage hole 26 and the second annular portion 22 side of the exhaust gas passage hole 26, with respect to the turbo axis direction, in the turbo circumference direction. The substantially identically shaped column portions 27 are provided in four locations of the annular base 20 according to this embodiment, which includes the four exhaust gas passage holes 26 provided at equal intervals in the turbo circumference direction.

Hence, in the manufacturing method according to this embodiment, the first annular portion 21 and second annular portion 22 are formed as the pair of annular portions provided in the annular base 20, which is formed by subjecting a plate-form member to deformation processing. Further, the connecting portion 23 that connects the annular portions (21, 22) to each other is formed from the cylindrical portion 24 and the R-shaped portion 25. Moreover, the exhaust gas passage holes 26 are provided in the connecting portion 23.

The deformation processing used to mold the annular base 20 having the respectively shaped parts described above is preferably performed as follows. In this embodiment, the deformation processing used to mold the annular base 20 is cold forging in which residual compressive stress or residual tensile stress is applied to at least the connecting portion 23 part in the turbo axis direction so as to counteract external force acting on the annular base 20 in the turbo axis direction.

External forces act on the annular base 20 due to thermal expansion and thermal contraction occurring during a thermal cycle that accompanies an operation of the engine, thermal deformation in constitutional components of the engine or peripheral components (a support stay and so on) of the turbocharger 1, vibration input during an operation of the engine, and so on. It has been learned through experiments and the like that, of these external forces acting on the annular base 20, an external force in the turbo axis direction, i.e. an external force acting in a direction for pulling the annular base 20 in the turbo axis direction (to be referred to hereafter as a "pulling direction external force") or an external force acting in a direction for compressing the annular base 20 in the turbo axis direction (to be referred to hereafter as a "compression direction external force"), is relatively large.

Therefore, cold forging is employed as the deformation processing used to mold the annular base 20, and during the cold forging, residual stress is applied in accordance with (in order to counteract) the turbo axis direction external force acting on the annular base 20. In other words, during cold forging for molding the annular base 20, residual stress is applied in the turbo axis direction during the molding. The direction and magnitude of the residual stress are controlled intentionally to counteract the turbo axis direction external force acting on the annular base 20.

Accordingly, when the pulling direction external force is larger than the compression direction external force as the external force acting on the annular base 20, turbo axis direction residual compressive stress (to be referred to simply as "residual compressive stress" hereafter) is applied as residual stress during the cold forging, and conversely, when the compression direction external force is larger than the pulling direction external force as the external force acting on the annular base 20, turbo axis direction residual tensile stress (to be referred to simply as "residual tensile stress" hereafter) is applied as residual stress during the cold forging.

An example of a case in which residual compressive stress is applied to the annular base 20 will now be described using FIG. 8. As described above, residual compressive stress is applied to the annular base 20 when the pulling direction external force is the larger component of the external force acting on the annular base 20.

Figure 8:
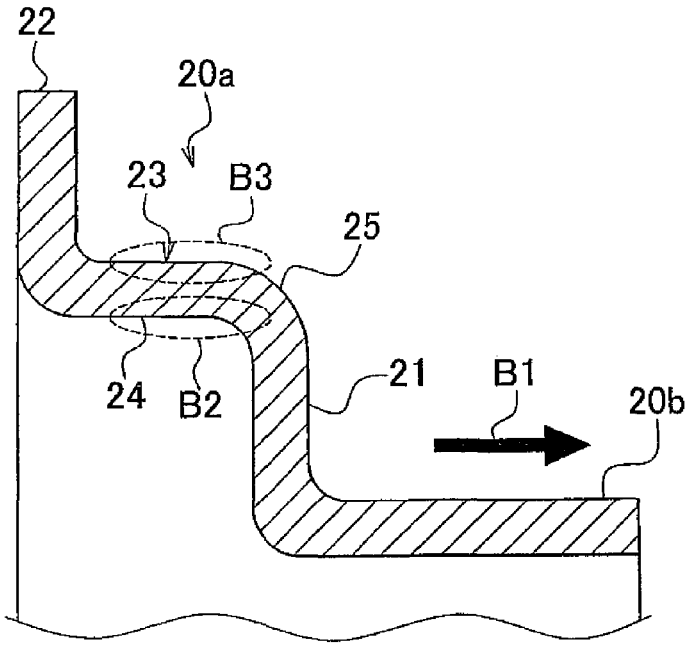
FIG. 8 is an illustrative view showing residual compressive stress applied to the annular base.

As shown in FIG. 8, when the pulling direction external force is applied to the annular base 20 (see arrow B1), a tensile load is applied to the part of the connecting portion 23 located on the inside of the turbo diameter direction (see region B2), whereas a compressive load is applied to the part of the connecting portion 23 located on the outside of the turbo diameter direction (see region B3). Hence, residual compressive stress is applied to the connecting portion 23 during cold forging of the annular base 20 to counteract the loads applied to the respective parts of the connecting portion 23.

More specifically, the residual compressive stress applied to the connecting portion 23 in this case is residual stress constituted by compressive stress remaining in the part of the annular base 20 (see region B2) to which the tensile load is applied due to the pulling direction external force and tensile stress remaining in the part of the annular base 20 (see region B3) to which the compressive load is applied due to the same pulling direction external force. In other words, the residual compressive stress applied to the annular base 20 is residual stress acting in a direction for compressing the annular base 20 in the turbo axis direction, which is constituted by loads remaining in each part of the annular base 20 in order to counteract a load (a tensile load or a compressive load) acting on each part due to the action of the pulling direction external force.

Accordingly, when the compression direction external force is the larger component of the external force acting on the annular base 20, residual tensile stress is applied to the annular base 20 in the following manner, for example. When the compression direction external force acts on the annular base 20, a compressive load is applied to the part of the connecting portion 23 located on the inside of the turbo diameter direction (see region B2) and a tensile load acts on the part of the connecting portion 23 located on the outside of the turbo diameter direction (see region B3).

Therefore, residual tensile stress is applied to the connecting portion 23 during cold forging of the annular base 20 in order to counteract the loads applied to the respective parts of the connecting portion 23. More specifically, residual stress constituted by tensile stress remaining in the part of the annular base 20 (see region B2) on which a compressive load acts due to the compression direction external force and compressive stress remaining in the part of the annular base 20 (see region B3) on which a tensile load acts due to the same compression direction external force is applied to the annular base 20 as the residual tensile stress. In other words, the residual tensile stress applied to the annular base 20 is residual stress acting in a direction for pulling the annular base 20 in the turbo axis direction, which is constituted by loads remaining in respective parts of the annular base 20 in order to counteract a load (a tensile load or a compressive load) acting on the respective parts due to the compression direction external force.

Note that there are no particular limitations on the part of the annular base 20 to which residual stress is applied during cold forging as long as the part includes the connecting portion 23. The residual stress in the annular base 20 is preferentially applied to the connecting portion 23 part, in which the annular base 20 is more likely to be deformed by a turbo axis direction external force, but the residual stress may be applied to a part other than the connecting portion 23, such as the first annular portion 21 or the second annular portion 22, for example. Further, the part of the annular base 20 to which the residual stress is applied, the direction and magnitude of the residual stress, and so on are adjusted in accordance with the shape of a die used in the cold forging, a sequence of cold forging processes such as drawing performed on the respective parts, and so on.

As described above, in the manufacturing method according to this embodiment, the deformation processing used to mold the annular base 20 is cold forging in which residual compressive stress or residual tensile stress is applied to at least the connecting portion 23 part in the turbo axis direction so as to counteract external force acting on the annular base 20 in the turbo axis direction.

With the turbocharger 1 and manufacturing method thereof according to this embodiment, a reduction in the amount by which the turbine housing 6 deforms due to thermal deformation, as well as an improvement in the fatigue life and a reduction in the cost of the turbine housing 6, can be achieved, and a favorable surface roughness can be obtained such that loss of the exhaust gas flowing along a wall surface is suppressed.

More specifically, in the turbocharger 1 according to this embodiment, the annular base 20 that forms the turbine housing 6 is molded by cold forging in which residual stress for counteracting external force acting in the turbo axis direction is applied to the annular base 20. Therefore, thermal deformation caused by external forces input into the annular base 20 as a result of thermal expansion and thermal contraction occurring during a thermal cycle that accompanies an operation of the engine and so on is canceled out or reduced. As a result, the amount of thermal deformation in the annular base 20 decreases, leading to an improvement in the fatigue life of the annular base 20.

Further, with deformation processing such as cold forging, a reduction in cost can be achieved easily in comparison with processing such as casting or welding. Moreover, deformation processing such as cold forging employs a plate-form member such as SUS sheet metal, and therefore more favorable surface roughness can be obtained on the surface of the annular base 20 than with casting and so on. As a result, loss of the exhaust gas flowing along the wall surface (surface) of the annular base 20 can be suppressed. Furthermore, with deformation processing such as cold forging, the processing can be simplified in comparison with welding.

Figure 9:
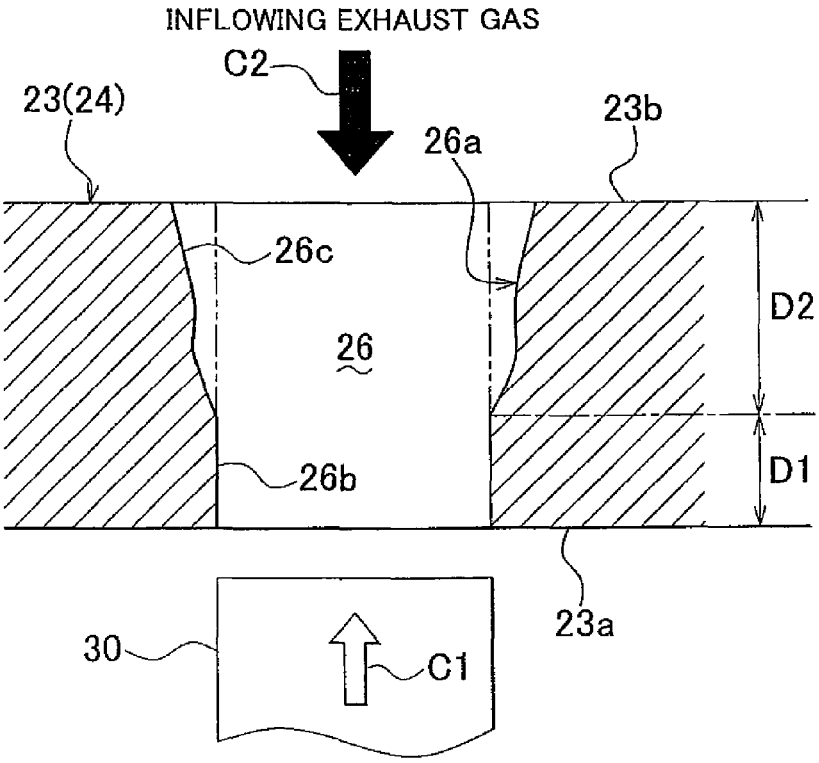
FIG. 9 is an illustrative view showing an exhaust gas passage hole.

Incidentally, the exhaust gas passage hole 26 formed in the connecting portion 23 as described above is preferably formed by punching the connecting portion 23 from the inside to the outside of the turbo diameter direction. More specifically, as shown in FIG. 9, the exhaust gas passage hole 26 formed in the connecting portion 23 is formed by punching using a punch 30, for example. In this case, the exhaust gas passage hole 26 is punched by moving the punch 30 relative to the connecting portion 23 from the inside (the lower side in FIG. 9) to the outside (the upper side in FIG. 9) of the turbo diameter direction (see arrow C1).

When the exhaust gas passage hole 26 is formed by punching the connecting portion 23 from the inside to the outside of the turbo diameter direction in this manner, the exhaust gas passage hole 26 takes the following shape. As shown in FIG. 9, when the exhaust gas passage hole 26 is formed by punching, a surface (to be referred to hereafter as a "passage hole formation surface") 26*a* for forming the exhaust gas passage hole 26 includes a shear surface 26*b* that corresponds to the shape of the punch 30 and a fractured surface 26*c* that widens gradually from the shear surface 26*b* in a punching direction.

Here, the shear surface 26*b* formed on the passage hole formation surface 26*a* is cut by shearing force generated by a blade of the punch 30 while contacting the passage hole formation surface 26*a*. Accordingly, the shear surface 26*b* takes a shape that corresponds to the punching direction (an upward direction in FIG. 9; likewise hereafter). The shear surface 26*b* is formed on a near side (the lower side in FIG. 9) of the passage hole formation surface 26*a* in the punching direction. Hence, in this embodiment, the shear surface 26*b* is formed in a part of the passage hole formation surface 26*a* located on the inside of the turbo diameter direction, or in other words a part located on the inner peripheral side of the annular base 20 (see arrow range D1).

Meanwhile, the fractured surface 26*c* formed on the passage hole formation surface 26*a* is cut by a fracture based on tensile stress generated by the punch 30 during punching. Accordingly, the fractured surface 26*c* takes a shape that widens in the punching direction. The fractured surface 26*c* is formed on a far side (the upper side in FIG. 9) of the passage hole formation surface 26*a* in the punching direction. Hence, in this embodiment, the fractured surface 26*c* is formed in a part of the passage hole formation surface 26*a* located on the outside of the turbo diameter direction, or in other words a part located on the outer peripheral side of the annular base 20 (see arrow range D2).

Thus, the fractured surface 26*c* is continuous with the far side of the shear surface 26*b* in the punching direction, and serves to widen the exhaust gas passage hole 26 gradually in the punching direction from the shear surface 26*b*. Therefore, due to the fractured surface 26*c*, the outer peripheral side part of the exhaust gas passage hole 26 formed by punching the connecting portion 23 from the inside to the outside of the turbo diameter direction takes a substantially tapered form that widens from the inside to the outside of the turbo diameter direction when seen in cross-section, as shown in FIG. 9.

By forming the outer peripheral side part of the exhaust gas passage hole 26 in a substantially tapered form that widens from the inside to the outside of the turbo diameter direction, the exhaust gas is led from the exhaust gas passage 8 to the turbine wheel 2 through the exhaust gas passage hole 26 smoothly. More specifically, the exhaust gas that is led to the turbine wheel 2 from the exhaust gas passage 8 flows into the exhaust gas passage hole 26 from the outer peripheral side (the outside of the turbo diameter direction) (see arrow C2), and therefore, by forming the exhaust gas passage hole 26 in a substantially tapered form that is wider on the outer peripheral side, the exhaust gas is led from the exhaust gas passage 8 to the turbine wheel 2 through the exhaust gas passage hole 26 smoothly.

Hence, in the manufacturing method according to this embodiment, the exhaust gas passage hole 26 is preferably formed by punching the connecting portion 23 from the inside to the outside of the turbo diameter direction. In so doing, the outer peripheral side part of the exhaust gas passage hole 26 takes a substantially tapered form, and therefore the exhaust gas can be led to the turbine wheel 2 from the exhaust gas passage 8 smoothly without performing additional processing such as chamfering processing, for example, on the outer peripheral side part of the exhaust gas passage hole 26.

Furthermore, in the annular base 20 according to this embodiment, the exhaust gas passage hole 26 formed in the connecting portion 23 as an elongated hole having the turbo circumference direction as a lengthwise direction, as described above, is provided in a plurality in the turbo circumference direction in opposing turbo diameter direction positions. The annular base 20 according to this embodiment is provided with two sets of (a total of four) exhaust gas passage holes 26 respectively opposing each other in the turbo diameter direction. As described above, the four exhaust gas passage holes 26 are provided at equal intervals in the turbo circumference direction.

More specifically, as shown in FIG. 7, the four exhaust gas passage holes 26 are constituted by a pair of exhaust gas passage holes 26 (26A) opposing each other in arbitrary positions in the turbo diameter direction (the up-down direction in FIG. 7), and a pair of exhaust gas passage holes 26 (26B) opposing each other in a perpendicular direction (the left-right direction in FIG. 7) to the opposing direction of the pair of exhaust gas passage holes 26A. In other words, the respective pairs of exhaust gas passage holes 26 opposing each other in the turbo diameter direction are formed in positions removed from each other by 180° in the turbo circumference direction.

Further, the pairs of exhaust gas passage holes 26 opposing each other in the turbo diameter direction are formed symmetrically with respect to the turbo diameter direction. In FIG. 7, which corresponds to a view from the turbo axis direction, the pair of exhaust gas passage holes 26 (26A) opposing each other in the up-down direction is formed in line symmetry relative to a left-right direction straight line passing through the rotary axis center C (see FIG. 1) and in, turbo circumference direction positions. Similarly, in FIG. 7, the pair of exhaust gas passage holes 26 (26B) opposing each other in the left-right direction is formed in line symmetry relative to an up-down direction straight line passing through the rotary axis center C and in turbo circumference direction positions.

By thus providing a plurality of exhaust gas passage holes 26 in the turbo circumference direction in opposing turbo diameter direction positions, the respective pairs of opposing exhaust gas passage holes 26 can be formed in a single punching process. In other words, the two exhaust gas passage holes 26 provided at a 180° interval in the turbo circumference direction can be formed in a single punching process. As a result, the formation cost of the exhaust gas passage holes 26 can be reduced.

Figure 10A:
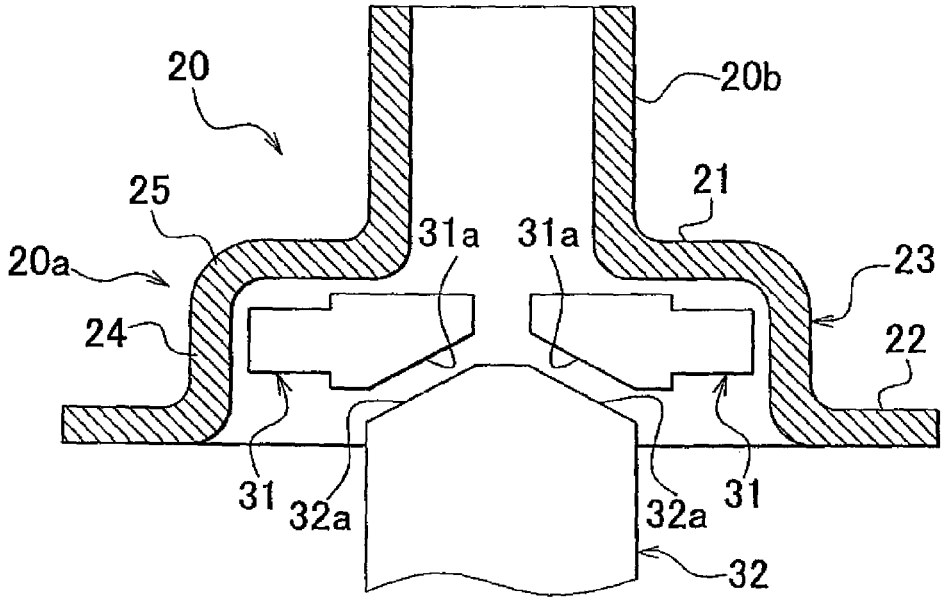
FIGS. 10A and 10B are illustrative views showing constitutions and processes for forming an exhaust gas passage hole.
Figure 10B:
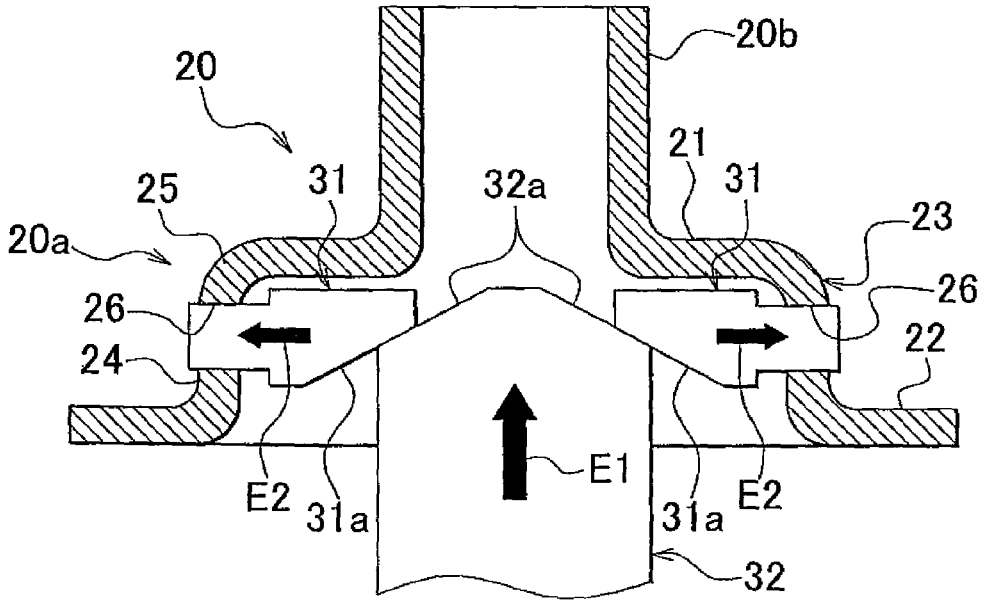

The following constitution, for example, may be employed to form the pairs of opposing exhaust gas passage holes 26 in a single punching process. As shown in FIGS. 10A and 10B, a constitution according to this embodiment includes a pair of punches 31 for punching the pair of exhaust gas passage holes 26 and a slider 32 for moving the pair of punches 31.

The pair of punches 31 are provided relative to the annular base 20 so that they can be moved in conjunction with each other from the inside to the outside of the turbo diameter direction. The pair of punches 31 are supported by a guide mechanism or the like, not shown in the drawings, to be capable of moving in a predetermined movement direction including a direction for punching the exhaust gas passage holes 26.

The slider 32 is provided so that it can be moved by a moving mechanism (not shown) constituted by a hydraulic cylinder, a motor, or similar, for example, in a perpendicular direction (the up-down direction of FIGS. 10A and 10B) to the movement direction of the pair of punches 31. By moving the slider 32 in a direction (the up direction in FIGS. 10A and 10B) heading toward the pair of punches 31, the pair of punches 31 are moved in conjunction in the direction for punching the exhaust gas passage holes 26.

The movement of the slider 32 is converted into movement of the pair of punches 31 by an engagement portion between the respective punches 31 and the slider 32. The engagement portion between the respective punches 31 and the slider 32 is constituted by a mating surface between an engagement surface 31*a* of each punch 31 and an engagement surface 32*a* of the slider 32. The engagement surface 31*a* of the punch 31 and the engagement surface 32*a* of the slider 32 are constituted by inclined surfaces inclined relative to the movement directions of the respective portions such that the movement of the slider 32 toward the pair of punches 31 is converted into movement of the pair of punches 31 from the inside to the outside of the turbo diameter direction (i.e. the punching direction). In other words, the engagement surface 31*a* of the punch 31 and the engagement surface 32*a* of the slider 32 constitute sliding surfaces with respect to the movement of the pair of punches 31 accompanying the movement of the slider 32.

In this embodiment, the exhaust gas passage holes 26 are formed in the following manner. As shown in FIG. 10A, the pair of punches 31 are set in the interior of the annular base 20 prior to formation of the exhaust gas passage holes 26 for the annular base 20 in predetermined turbo axis direction positions corresponding to the exhaust gas passage holes 26. From this state, the slider 32 is moved in a direction heading toward the punch 31 side until the slider 32 engages with the pair of punches 31, or in other words until the engagement surface 32*a* of the slider 32 contacts the respective engagement surfaces 31*a* of the punches 31.

From this state of engagement with the pair of punches 31, the slider 32 is moved further in the direction for engaging with the punches 31 (the up direction in FIG. 10B), as shown in FIG. 10B (see arrow E1), causing the pair of punches 31 to move toward the outside of the turbo diameter direction (see arrow E2). In other words, as the slider 32 moves in the direction of the arrow E1, the pair of punches 31 move in the outside direction of the turbo diameter direction (the direction of the arrow E2) while the respective engagement surfaces 31*a* thereof slide along the engagement surface 32*a* of the slider 32, and through this movement of the pair of punches 31, the exhaust gas passage holes 26 are formed in the connecting portion 23 of the annular base 20 at a 180° interval in the turbo circumference direction.

Hence, with the manufacturing method according to this embodiment, the exhaust gas passage holes 26 are formed in opposing turbo diameter direction positions in the turbo circumference direction in a single process. In other words, the pair of exhaust gas passage holes 26 (26A) opposing each other in the turbo diameter direction as shown in FIG. 7, for example, is formed in the annular base 20 according to this embodiment in the single process described above for moving the pair of punches 31, 31 and the slider 32.

Therefore, in a case where two sets of (a total of four) exhaust gas passage holes 26 opposing each other in the turbo diameter direction are formed, as in the annular base 20 according to this embodiment, the four exhaust gas passage holes 26 are formed in two processes. More specifically, according to this embodiment, after forming the pair of exhaust gas passage holes 26 opposing each other in the turbo diameter direction, the constitution including the pair of punches 31 and the slider 32 is rotated 90° using the turbo axis direction as a rotary axis direction, whereupon the other pair of exhaust gas passage holes 26 is formed.

Note that there are no particular limitations on the number of exhaust gas passage holes 26 provided in the annular base 20 as long as a plurality of the exhaust gas passage holes 26 are provided in opposing turbo diameter direction positions. Accordingly, the exhaust gas passage holes 26 may be provided in a single set (a total of two) or three or more sets (a total of six or more) so as to oppose each other in the turbo diameter direction.

Further, in the annular base 20 according to this embodiment, the connecting portion 23 provided with the exhaust gas passage holes 26 includes the cylindrical portion 24 and the R-shaped portion 25, and the exhaust gas passage holes 26 are provided in the cylindrical portion 24, as described above. In other words, the four exhaust gas passage holes 26 constituted by elongated hole portions having the turbo circumference direction as a lengthwise direction are formed in the cylindrical portion 24 having a cylindrical overall outer shape.

Figure 6:
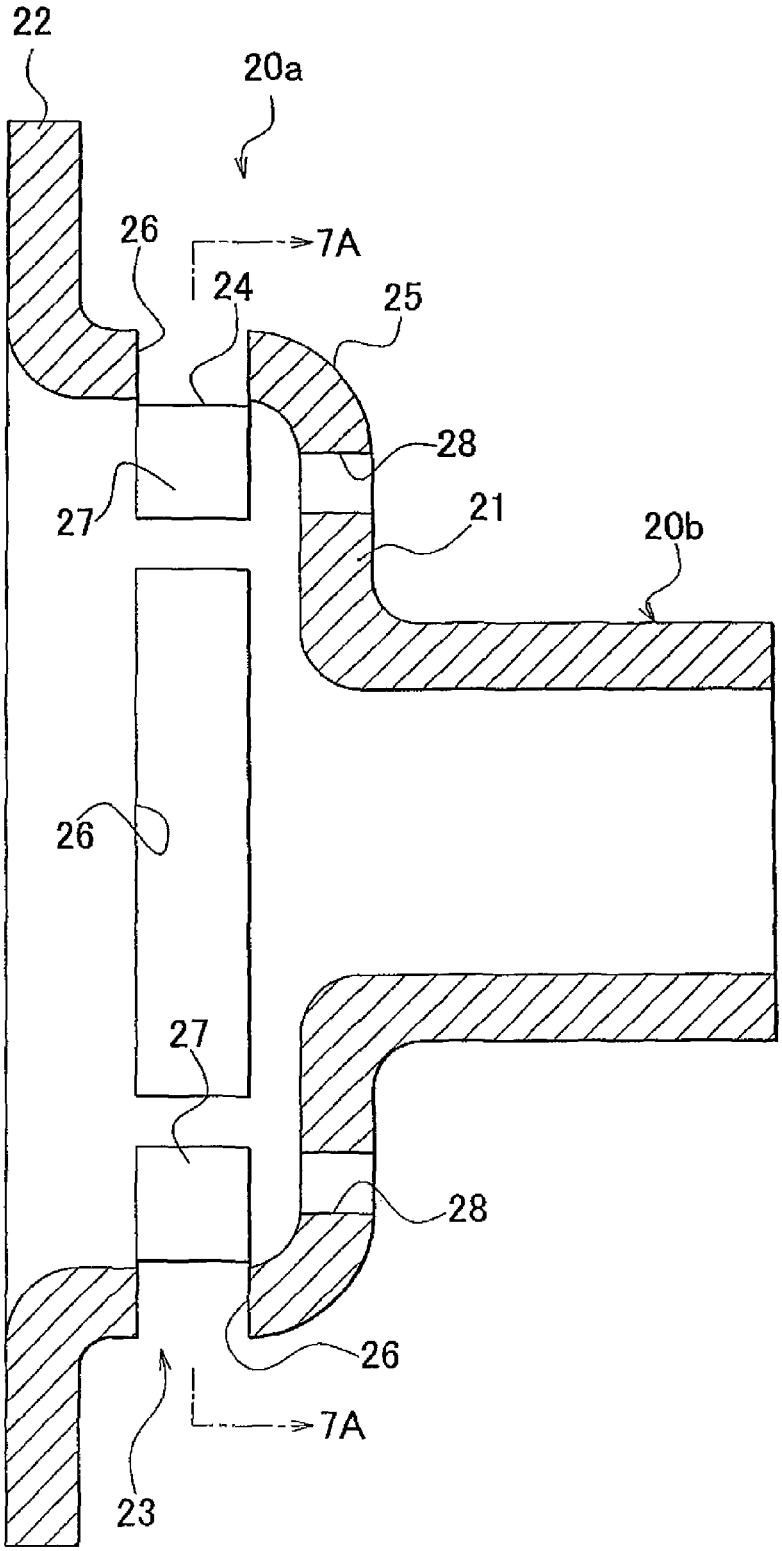
FIG. 6 is a sectional view showing the constitution of the annular base.
Figure 7:
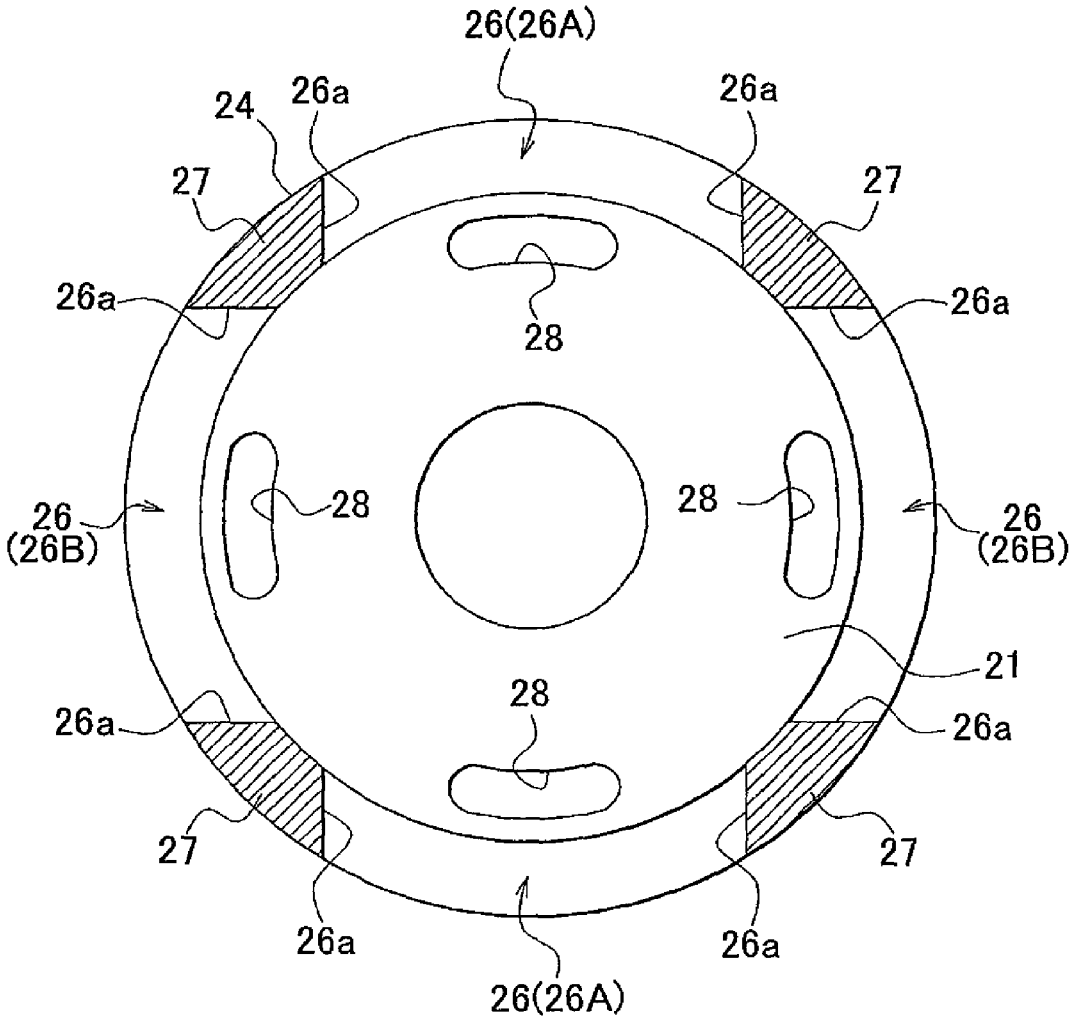
FIG. 7 is a 7A-7A sectional view of FIG. 6.

More specifically, the exhaust gas passage holes 26 are formed by performing punching or the like in the manner described above on the cylindrical portion 24, which forms a planar part when the annular base 20 is seen from a cross-section including a straight line that passes through the rotary axis center C in the turbo axis direction, as shown in FIG. 6 and so on, for example. In other words, the exhaust gas passage holes 26 provided in the cylindrical portion 24 are formed without disturbing the R-shaped portion 25 that constitutes the connecting portion 23 together with the cylindrical portion 24 (i.e. leaving the R-shaped portion 25 intact).

By providing the exhaust gas passage holes 26 in the cylindrical portion 24 of the connecting portion 23 in this manner, the exhaust gas led to the turbine wheel 2 through the exhaust gas passage holes 26 after revolving around the exhaust gas passage 8 is rectified. Moreover, a favorable performance can be secured in the turbocharger 1 and deformation of the annular base 20 can be suppressed.

More specifically, by providing the exhaust gas passage holes 26 in the cylindrical portion 24 of the connecting portion 23, the exhaust gas passage holes 26 serve as hole portions opened in the turbo diameter direction such that the R-shaped portion 25 forming the connecting portion 23 exists around the entire periphery of the turbo circumference direction. Hence, an inner peripheral surface of the R-shaped portion 25, which is a smooth curved surface, exists around the entire periphery of the turbo circumference direction as a wall surface of the annular base 20 that corresponds to the flow of exhaust gas from the exhaust gas passage holes 26 to the inside of the annular base 20. As a result, the exhaust gas led to the VN mechanism portion 11 through the exhaust gas passage holes 26 is rectified.

If the exhaust gas passage holes 26 are formed in a part including the R-shaped portion 25, a wall surface that obstructs the flow of the exhaust gas flowing through the exhaust gas passage holes 26 after revolving around the exhaust gas passage 8 is formed in the annular base 20, and as a result, the exhaust gas may not be able to flow smoothly. In this embodiment, however, the R-shaped portion 25 is formed around the entire periphery of the turbo circumference direction, and therefore the exhaust gas flow is rectified, as described above.

Further, by providing the exhaust gas passage holes 26 in the cylindrical portion 24 of the connecting portion 23, a throat area (a fluid passage area) of the VN mechanism portion 11 is secured by the exhaust gas passage holes 26. By securing the exhaust gas passage area, a favorable performance can be secured in the turbocharger 1. Moreover, since the R-shaped portion 25 exists around the entire periphery of the turbo circumference direction, a high degree of rigidity can be secured in the annular base 20 against turbo axis direction external forces and the like, whereby deformation of the annular base 20 is suppressed.

Furthermore, with regard to heat capacity reduction, the first annular portion 21 of the annular base 20 according to this embodiment includes a weight reduction hole 28, which is a hole portion for reducing the weight of the annular base 20. The weight reduction hole 28 penetrates the first annular portion 21, which is a flat plate-form part formed such that a plate surface thereof is perpendicular to the turbo axis direction, in the turbo axis direction. Note that the weight reduction hole 28 formed in the first annular portion 21 may also be used to position the annular base 20 relative to the shell 7 and so on.

Figure 5:
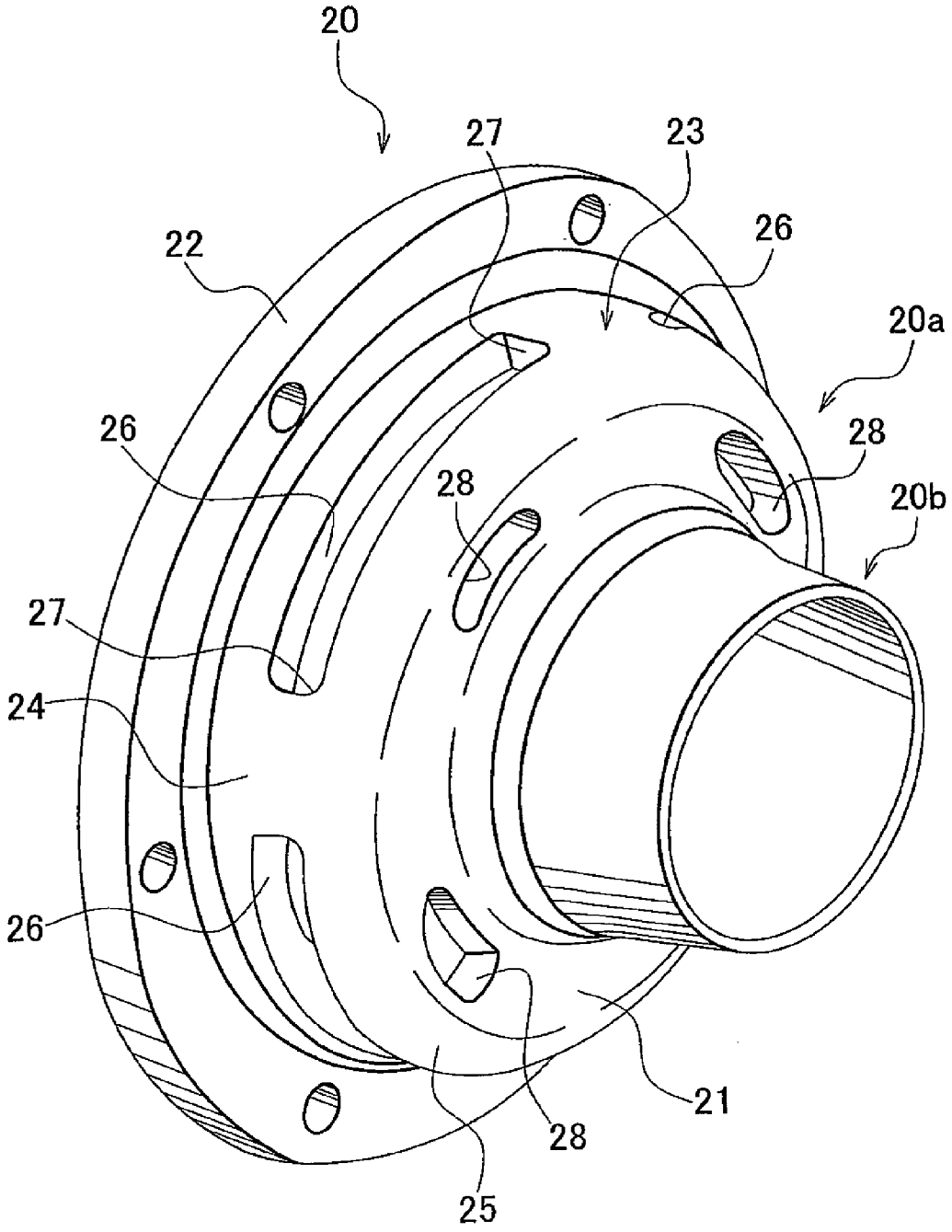
FIG. 5 is a perspective view showing the constitution of an annular base.

As shown in FIGS. 5, 7 and so on, the weight reduction hole 28 is an elongated hole that has the turbo circumference direction as a lengthwise direction and curves in alignment with an arc shape of the first annular portion 21. A turbo circumference direction length of the weight reduction hole 28 is formed to be shorter than that of the exhaust gas passage hole 26, which is formed as an elongated hole having the turbo circumference direction as a lengthwise direction similarly to the weight reduction hole 28. In this embodiment, four weight reduction holes 28 are provided at equal intervals in the turbo circumference direction.

The weight reduction holes 28 provided in the first annular portion 21 are provided in positions corresponding substantially to the center of the exhaust gas passage holes 26 with respect to the turbo circumference direction. More specifically, as shown in FIG. 7, the four weight reduction holes 28 provided in an identical number to the exhaust gas passage holes 26 but having a shorter turbo circumference direction length than the exhaust gas passage holes 26 are provided relative to the respective exhaust gas passage holes 26 in substantially central positions with respect to the turbo circumference direction.

In other words, the weight reduction holes 28 are provided in substantially central positions between adjacent column portions 27 in the turbo circumference direction. Hence, the weight reduction holes 28 are provided alternately with the column portions 27 in the turbo circumference direction.

Therefore, in the manufacturing method according to this embodiment, the weight reduction holes 28 are provided in the first annular portion 21 in positions corresponding substantially to the center of the respective exhaust gas passage holes 26 with respect to the turbo circumference direction. As a result, the weight of the annular base 20 can be reduced, and since a reduction in the rigidity of the part including the first annular portion 21 and the connecting portion 23 due to provision of the weight reduction holes 28 can be suppressed, deformation of the annular base 20 can be suppressed.

More specifically, if the weight reduction holes 28 are formed close to the column portions 27 in the turbo circumference direction, it becomes difficult to secure sufficient strength in a first annular portion 21 side connecting part of the column portion 27. The connecting part of the column portion 27 is greatly affected by external forces acting on the annular base 20, and therefore, when the weight reduction holes 28 are formed close to the column portions 27 in the turbo circumference direction, the rigidity of the part including the first annular portion 21 and the connecting portion 23 against turbo axis direction external forces and so on may become deficient. Hence, by providing the weight reduction holes 28 in positions corresponding substantially to the center of the respective exhaust gas passage holes 26 in the turbo circumference direction, it is possible to reduce the weight of the annular base 20 while securing sufficient rigidity in the part including the first annular portion 21 and the connecting portion 23.

Furthermore, in the first annular portion 21, the formation sites of the exhaust gas passage holes 26 in the turbo circumference direction have reduced flatness due to formation of the exhaust gas passage holes 26. More specifically, the exhaust gas passage holes 26 are formed by performing punching from the inside to the outside of the turbo diameter direction, for example, as described above, and therefore the sites of the first annular portion 21 that correspond to the respective exhaust gas passage holes 26 have reduced flatness due to pulling of the material and so on during punching of the exhaust gas passage holes 26. The flatness of the first annular portion 21 decreases to a comparatively large degree in a central portion of the exhaust gas passage hole 26 with respect to the turbo circumference direction.

The flat plate-shaped first annular portion 21 may be used to position another member relative to the annular base 20 during welding or the like. Therefore, a predetermined degree of flatness is preferably secured in the first annular portion 21. In other words, when the flatness of the first annular portion 21 is poor, additional processing may be required to obtain the predetermined degree of flatness.

Hence, by providing the weight reduction holes 28 in positions of the first annular portion 21 corresponding substantially to the center of the respective exhaust gas passage holes 26 with respect to the turbo circumference direction, the sites in which the flatness of the first annular portion 21 decreases to a comparatively large degree are excluded. As a result, a reduction in the flatness of the first annular portion 21 accompanying formation of the exhaust gas passage holes 26 can be suppressed, enabling an improvement in the surface precision of the annular base 20.

Further, in the turbocharger 1 according to this embodiment, the outlet flange 10 is provided at the exhaust gas outlet of the turbine housing 6, as described above. The outlet flange 10 provided at the exhaust gas outlet in this manner is used as a member (a stay) for supporting the turbine housing 6 that forms the turbocharger 1 relative to a main body side of the engine in which the turbocharger 1 is installed. Alternatively, a stay is attached to the outlet flange 10. By having the outlet flange 10 support the turbine housing 6 on the engine main body side, vibration of the turbocharger 1 accompanying vibration occurring during an operation of the engine can be suppressed.

More specifically, in this embodiment, the outlet flange 10 functions as a support member that supports the turbine housing 6 on the main body side of the engine. Accordingly, the outlet flange 10 supports the turbocharger 1 on the main body side of the engine via the turbine housing 6. The outlet flange 10 is provided on an end portion on the outlet side of the exhaust gas led to the turbine wheel 2, or in other words the peripheral edge of the tip end opening portion of the sleeve portion **20*b* of the annular base 20**, which serves as the exhaust gas outlet in this embodiment.

As shown in FIG. 1, the outlet flange 10 provided on the turbine housing 6 includes a fastening support portion 40. The fastening support portion 40 extends from the outlet flange 10 to the turbo diameter direction outside and is fastened to the engine main body side. In other words, by providing the outlet flange 10 according to this embodiment with the fastening support portion 40, the outlet flange 10 functions as a support member for supporting the turbine housing 6 on the engine main body side.

The fastening support portion 40 is continuous with a part of the outlet flange 10 in which an exhaust pipe connection bolt hole 10*a* is provided, and extends so as to project further toward the turbo diameter direction outside than the part of the outlet flange 10 in which the bolt hole 10*a* is formed. In the outlet flange 10 according to this embodiment, the fastening support portion 40 extends in a predetermined direction (the down direction in FIG. 1) corresponding to the turbo diameter direction.

The fastening support portion 40 includes a fastening hole 41. The fastening hole 41 is provided in a projection direction tip end portion of the fastening support portion 40. Hence, using the fastening hole 41 provided in the fastening support portion 40, the outlet flange 10 is fixed to a predetermined site on the engine main body side, such as a cylinder block forming the engine, for example, via another member or the like by a fastening tool such as a bolt. Thus, the outlet flange 10, which is fixed to the sleeve portion 20*b* of the annular base 20 by welding or the like, is fixed to the engine main body side by one end portion side (the fastening support portion 40 side) thereof. As a result, the turbine housing 6 is supported on the engine main body side by the outlet flange 10.

The outlet flange 10 including the fastening support portion 40 is provided such that a phase of the fastening support portion 40 corresponds to a predetermined phase with respect to an axial center phase of the rotary shaft 3 (the rotary axis center C). Here, the phase is a position about the rotary axis center C (a position in the turbo circumference direction). The predetermined phase of the fastening support portion 40 is an intermediate phase in the turbo circumference direction between adjacent column portions 27 provided between adjacent exhaust gas passage holes 26 in the turbo circumference direction. In other words, the outlet flange 10 is provided such that a projection direction phase of the fastening support portion 40 extending from the outlet flange 10 in the turbo diameter direction is an intermediate phase between adjacent column portions 27.

Figure 11:
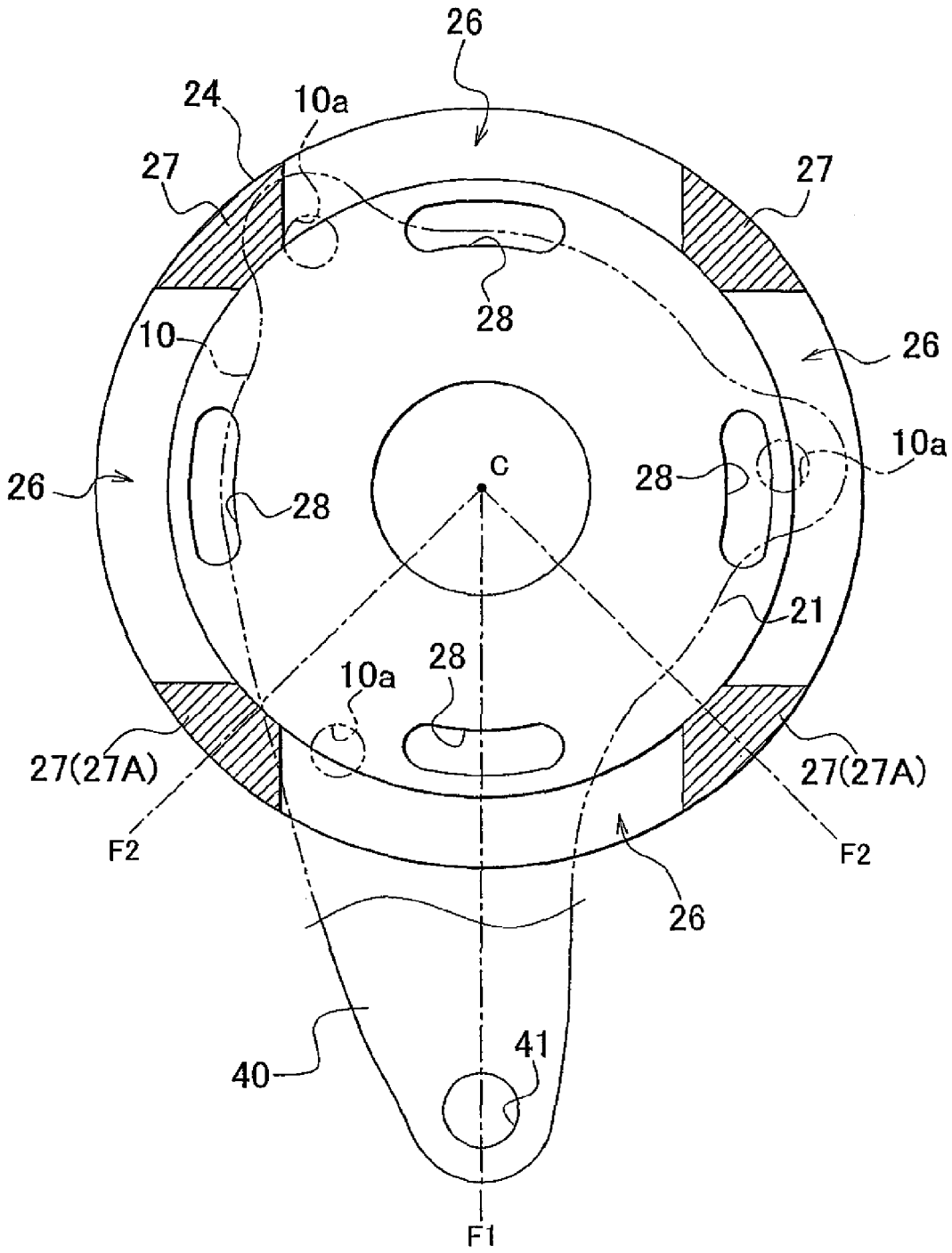
FIG. 11 is an illustrative view showing a positional relationship between the annular base and an outlet flange.

More specifically, as shown in FIG. 11, the outlet flange 10 is provided such that the phase of the fastening support portion 40 (see straight line F1) relative to the rotary axis center C is an intermediate phase between the phases (see straight lines F2) of adjacent column portions 27 (27A). In this embodiment, the phase of the fastening support portion 40 corresponds to the phase of (a center position of) the fastening hole 41 provided in the tip end portion of the fastening support portion 40, while the phase of the column portion 27 corresponds to the phase of a center position of the column portion 27 in the turbo circumference direction.

Hence, when a phase difference (a phase interval) between the two column portions 27 (27A) sandwiching the fastening support portion 40 in the turbo circumference direction is substantially 90°, the straight line F1 indicating the phase of the fastening support portion 40 has a phase difference of substantially 45° relative to the two straight lines F2 indicating the respective phases of the two column portions 27 (27A), for example. In other words, when an angle formed by the two straight lines F2 indicating the respective phases of the two column portions 27 (27A) sandwiching the fastening support portion 40 (i.e. an angle between the sandwiching sides of the fastening support portion 40) is substantially 90°, the outlet flange 10 is provided such that the straight line F1 indicating the phase of the fastening support portion 40 is at an angle of substantially 45° relative to both of the straight lines F2.

Therefore, in the manufacturing method according to this embodiment, the outlet flange 10 is provided such that the phase of the fastening support portion 40 about the rotary axis center C is an intermediate phase between adjacent column portions 27 in the turbo circumference direction. Thus, an external force input from the outlet flange 10 into the annular base 20 via the fastening support portion 40 can be dispersed among a plurality of the column portions 27 (mainly the two column portions 27 (27A) sandwiching the fastening support portion 40), and as a result, the durability of the annular base 20 can be improved without increasing a sectional area of the column portion 27.

More specifically, if the outlet flange 10 is provided such that the phase of the fastening support portion 40 is substantially identical to the phase of a column portion 27 of the annular base 20, for example, a load (stress) generated by an external force input from the outlet flange 10 into the annular base 20 via the fastening support portion 40 concentrates in the column portion 27 having a substantially identical phase to the phase of the fastening support portion 40. When stress is concentrated in a single column portion 27 in this manner, it is impossible to obtain sufficient durability in the annular base 20 against the external force.

To improve the durability of the annular base 20 against the external force, the sectional area of the column portion 27 may be increased. However, when the sectional area of the column portion 27 is increased, the plate thickness of the annular base 20 increases and the exhaust gas passage holes 26 must be narrowed, thereby restricting the exhaust gas passage area. An increase in the plate thickness of the annular base 20 leads to an increase in the weight of the annular base 20, which is undesirable in terms of reducing the heat capacity. Further, a restriction on the exhaust gas passage area leads to a reduction in the performance level of the turbocharger 1.

Hence, by providing the outlet flange 10 such that the phase of the fastening support portion 40 is an intermediate phase between two column portions 27, the durability of the annular base 20 can be improved without increasing the sectional area of the column portion 27, thereby avoiding an increase in the heat capacity of the annular base 20 and so on.

Note that the shape, disposal position, and so on of the fastening support portion 40 provided in the outlet flange 10 are not limited to the examples described in this embodiment. Furthermore, in this embodiment, the fastening support portion 40 is provided in a single location of the outlet flange 10, but may be provided in a plurality of locations. Further, in this embodiment, the outlet flange 10 is used as a support member including the fastening support portion 40, but is not limited thereto. In other words, a different member to the outlet flange 10 may be used as the support member including the fastening support portion 40. Moreover, with regard to the phase of the fastening support portion 40, the intermediate phase between adjacent column portions 27 in the turbo circumference direction is an arbitrary phase between two adjacent column portions 27 in the turbo circumference direction, but preferably a central phase between two column portions 27.

As described above, a heat-resistant material such as SUS sheet metal is used as the plate-form member that is molded into the annular base 20 of the turbocharger 1 according to this embodiment. Rolled steel plate is typically employed as this heat-resistant material.

Figure 12A:
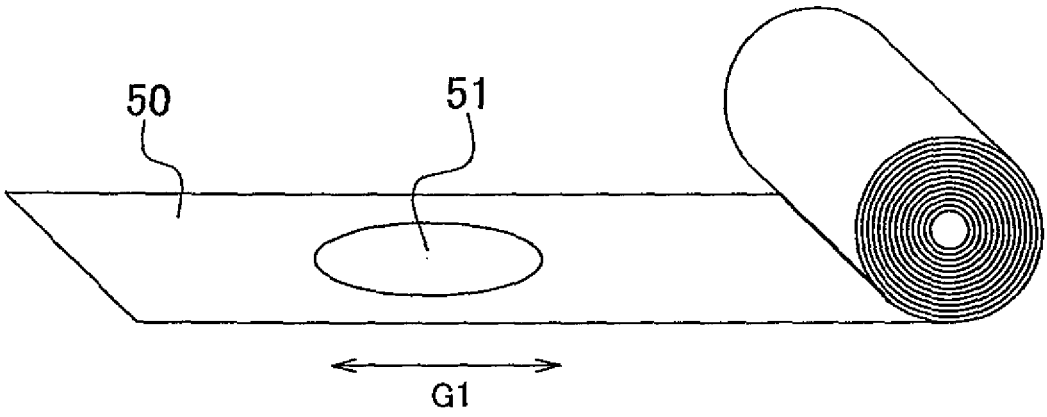
FIGS. 12A and 12B are illustrative views showing a material for forming the annular base.

More specifically, as shown in FIG. 12A, for example, the plate-form member that is molded into the annular base 20 is obtained from a strip-form rolled steel plate 50. In other words, a circular blank 51 is cut from the rolled steel plate 50 as the plate material to be subjected to deformation processing such as cold forging. A lengthwise direction of the strip-form rolled steel plate 50 (a length direction of the strip, see arrow G1) corresponds to a rolling direction.

In the rolled steel plate 50 serving as the plate-form member for forming the annular base 20, an absolute value of a Δr value indicating plastic anisotropy is preferably no greater than 0.25. More specifically, the Δr value is defined as follows.

Figure 12B:
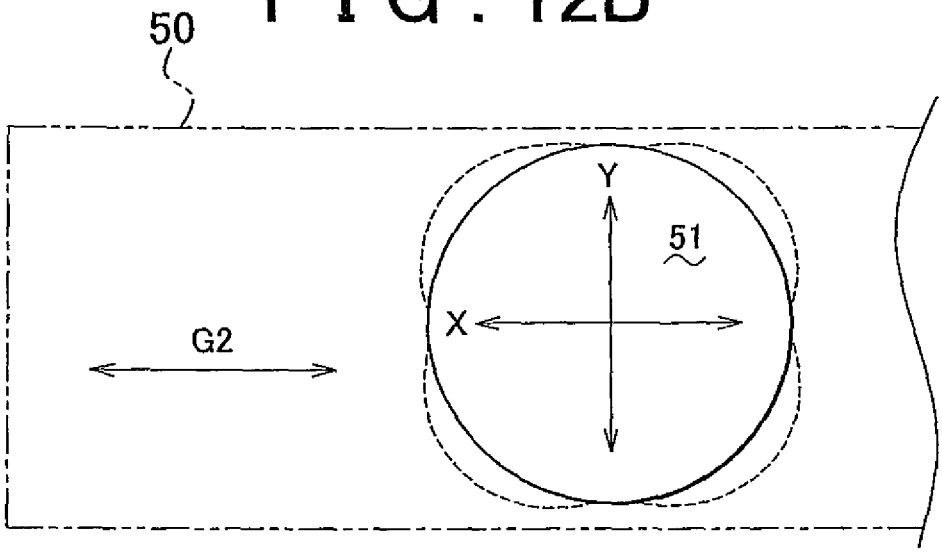

In the rolled steel plate 50, an r value (or a Lankford value) differs between the rolling direction (see arrow G1 in FIG. 12A) and a perpendicular direction (a width direction of the strip) to the rolling direction. More specifically, as shown in FIG. 12B, assuming that a direction corresponding to the rolling direction with respect to a plate surface direction of the rolled steel plate 50 is an X direction and a perpendicular direction to the direction corresponding to the rolling direction is a Y direction, the rolled steel plate 50 takes different r values in the X direction and the Y direction. Here, the r value is expressed as a ratio between a plate width direction distortion and a plate thickness direction distortion generated by simple tension applied to the plate material in a tension test, for example.

As noted above, the Δr value of the rolled steel plate 50 is a value indicating the difference between the X direction r value and the Y direction r value. Accordingly, the Δr value of the rolled steel plate 50 is determined in the following manner, for example.

Strip-shaped (rectangular) test pieces respectively having the X direction and the Y direction as a lengthwise direction are cut from the rolled steel plate 50. A tension test in which the lengthwise direction of the test piece is used as a pulling direction is then performed on each of the cut test pieces (the test piece having the X direction as its length direction and the test piece having the Y direction as its length direction), whereupon the r value of each test piece is determined. Thus, the X direction r value and Y direction r value of the rolled steel plate 50 are determined. The Δr value of the rolled steel plate 50 is then determined on the basis of the X direction r value and Y direction r value.

As the Δr value of the rolled steel plate 50 determined in the above manner decreases, the effect of the rolling direction (X direction) on the moldability of the corresponding material decreases. In other words, the shape precision (circularity, for example) of a molded component formed from the material improves as the Δr value decreases.

Therefore, when the Δr value is large, as shown in FIG. 12B, the blank 51 distorts from a perfectly circular shape to a shape approaching a square following deformation processing such as cold forging, as shown by a broken line in the drawing, for example. When the Δr value is small, on the other hand, the shape of the blank 51 remains close to a perfect circle even after the deformation processing, as shown by a solid line in the drawing. The blank 51 that is molded into the annular base 20 is preferably maintained in a shape approaching a perfect circle. In other words, the Δr value of the rolled steel plate 50 is preferably as small as possible. Note that in FIG. 12B, a direction indicated by an arrow G2 corresponds to the rolling direction of the rolled steel plate 50.

On the other hand, when a material having a large Δr value is used, surplus plate thickness must be secured during molding of the blank 51 in order to secure sufficient shape precision in the molded component (finished component). In other words, when the Δr value increases, the shape of the blank 51 distorts, as described above, and therefore, to obtain a desired shape (a perfect circular shape or the like, for example) in the annular base 20 molded from the blank 51, additional processing such as cutting, for example, must be implemented on the distorted molded component. Accordingly, a processing margin must be left for the additional processing, and as a result, surplus plate thickness must be secured during molding of the blank 51. When the plate thickness of the blank 51 is increased in this manner, the moldability of the blank 51 deteriorates.

Hence, a material having a Δr value (absolute value) of no greater than 0.25 is used as the rolled steel plate 50 serving as the plate-form material constituting the annular base 20. Thus, the material deformation effect that occurs in the rolling direction of the rolled steel plate 50 during molding of the annular base 20 by cold forging or the like is reduced, and as a result, a molded component having favorable shape precision (circularity or the like, for example) is obtained. In addition, there is no need to secure surplus plate thickness during molding of the blank 51 in order to secure sufficient shape precision in the molded component (finished component), and therefore favorable moldability is obtained.

The Δr value takes a partially fixed value according to the type of material used as the rolled steel plate 50. In an example experiment, the following results were obtained. When SUS430 was used as the rolled steel plate 50, distortion of the molded component was comparatively large, and it was therefore impossible to obtained sufficient shape precision. The Δr value of SUS430 is approximately 0.27. Meanwhile, when SUS425 was used as the rolled steel plate 50, distortion of the molded component was comparatively small and a shape approaching a perfect circle was obtained in the molded component. Hence, it was possible to obtain favorable shape precision. The Δr value of SUS425 is a value between 0.1 and 0.2.

As described above, a material in which the absolute value of the Δr value indicating plastic anisotropy does not exceed 0.25 is preferably used in the manufacturing method according to this embodiment as the plate-form material constituting the annular base 20. In so doing, improvements can be achieved in the shape precision and moldability of the molded component constituting the annular base 20.

The invention claimed is:

1. A manufacturing method for a turbocharger, wherein the turbocharger includes a turbine wheel that is driven by exhaust gas from an engine and supported rotatably by a predetermined rotary shaft, and a turbine housing that forms an exhaust gas passage that leads the exhaust gas to the turbine wheel, and wherein the turbine housing includes a housing main body constituted by a thin plate material and a reinforcement member that forms the exhaust gas passage together with the housing main body and reinforces the housing main body, the manufacturing method comprising:

molding the reinforcement member integrally by implementing deformation processing on a plate-form member to obtain a component that includes a pair of annular portions having a substantially annular shape so as to form ring-shaped plate-form parts formed such that a plate surface thereof is perpendicular to the turbo axis direction and being provided about an axial center of the rotary shaft at an interval in an axial direction of the rotary shaft, and a connecting portion that connects the pair of annular portions, punching the connecting portion to form a pair of exhaust gas passage holes in a single punching step, by punching the connecting portion from a diametrical direction inner side to a diametrical direction outer side of the rotary shaft, wherein the exhaust gas passage eholes lead the exhaust gas to the diametrical direction inner side of the rotary shaft, wherein an outer peripheral side part of the exhaust gas passage holes are in a substantially tapered form that widens toward an outer peripheral side, wherein the exhaust gas passage holes are elongated holes having a circumferential direction of the annular portion as a lengthwise direction, and are provided in the circumferential direction of the annular portion in opposing positions relative to the diametrical direction of the rotary shaft.

2. The manufacturing method according to claim 1, wherein cold forging, in which residual compressive stress or residual tensile stress is applied to at least the connecting portion part of the reinforcement member in the axial direction of the rotary shaft in order to counteract an external force acting on the reinforcement member in the axial direction of the rotary shaft, is performed as the deformation processing.

3. The manufacturing method according to claim 1, wherein a first annular portion positioned on an outlet side of the exhaust gas led to the turbine wheel with respect to the axial direction of the rotary shaft and a second annular portion positioned further toward the outer side of the diametrical direction of the rotary shaft than the first annular portion and on an opposite side to the outlet side with respect to the axial direction of the rotary shaft are formed as the pair of annular portions, the connecting portion is formed as a part that includes a cylindrical portion constituted by a cylindrical part having an axial center direction of the rotary shaft as a cylinder axis direction, one side of which in the cylinder axis direction is continuous with an inner peripheral side of the second annular portion, and an R-shaped portion constituted by a bent part extending continuously from another side of the cylindrical portion in the cylinder axis direction toward an outer peripheral side of the first annular portion, and the exhaust gas passage hole is provided in a plurality in the cylindrical portion.

4. The manufacturing method according to claim 1, further comprising:

providing a hole in a position of the first annular portion, the position corresponding substantially to a center of the exhaust gas passage hole with respect to the circumferential direction of the annular portion.

5. The manufacturing method according to claim 1, wherein the turbine housing is supported by a support member that is provided on an end portion of the outlet side of the exhaust gas led to the turbine wheel and includes a fastening support portion extending to the diametrical direction outer side of the rotary shaft and fastened to a main body side of the engine, the exhaust gas passage hole is provided in a plurality, the method further comprising:

providing the support member relative to column portions serving as parts disposed between adjacent exhaust gas passage holes in the circumferential direction of the annular portion such that with respect to a phase centering on the axial center of the rotary shaft, a phase of the fastening support portion is an intermediate phase between adjacent column portions in the circumferential direction of the annular portion.

6. The manufacturing method for a turbocharger according to claim 1, wherein a material in which an absolute value of an $\Delta r$ value indicating plastic anisotropy does not exceed 0.25 is used as the plate-form member constituting the reinforcement member.

* * * * *